US011227521B2

(12) United States Patent
Zheng et al.

(10) Patent No.: US 11,227,521 B2
(45) Date of Patent: Jan. 18, 2022

(54) GATE DRIVING CIRCUIT, GATE DRIVING METHOD, FOLDABLE DISPLAY PANEL, AND DISPLAY APPARATUS

(71) Applicant: BOE TECHNOLOGY GROUP CO., LTD., Beijing (CN)

(72) Inventors: Can Zheng, Beijing (CN); Libin Liu, Beijing (CN); Li Wang, Beijing (CN); Tian Dong, Beijing (CN); Guangliang Shang, Beijing (CN); Xinshe Yin, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 2 days.

(21) Appl. No.: 16/652,180

(22) PCT Filed: Oct. 18, 2019

(86) PCT No.: PCT/CN2019/111971
§ 371 (c)(1),
(2) Date: Mar. 30, 2020

(87) PCT Pub. No.: WO2020/173103
PCT Pub. Date: Sep. 3, 2020

(65) Prior Publication Data

US 2021/0217339 A1 Jul. 15, 2021

(30) Foreign Application Priority Data

Feb. 27, 2019 (CN) ..... 201910146362.4

(51) Int. Cl.
*G09G 3/00* (2006.01)

(52) U.S. Cl.
CPC ..... *G09G 3/035* (2020.08); *G09G 2300/0804* (2013.01); *G09G 2310/06* (2013.01); *G09G 2380/02* (2013.01)

(58) Field of Classification Search
CPC ..... G09G 3/035; G09G 2300/0804; G09G 2310/06; G09G 2380/02
See application file for complete search history.

(56) References Cited

U.S. PATENT DOCUMENTS

2012/0146978 A1* 6/2012 Park ..... G11C 19/287 345/211
2015/0348508 A1* 12/2015 Her ..... G09G 5/18 345/205

(Continued)

FOREIGN PATENT DOCUMENTS

CN 101984485 A 3/2011
CN 202058412 U 11/2011

(Continued)

OTHER PUBLICATIONS

Office Action dated Dec. 3, 2020, issued in counterpart CN Application No. 201910146362.4, with English Translation. (20 pages).

(Continued)

*Primary Examiner* — Towfiq Elahi
(74) *Attorney, Agent, or Firm* — Westerman, Hattori, Daniels & Adrian, LLP

(57) ABSTRACT

The present disclosure relates to a gate driving circuit applied to a foldable display panel comprising B display areas arranged in order. The gate driving circuit may include B gate driving subcircuits and a control circuit. Each of the gate driving subcircuits may correspond to one of the display areas and each of the gate driving subcircuits may comprise a plurality of stage gate driving units. The control circuit may be configured to, when the foldable display panel is in a full screen display state, control a type of an input signal in a last stage gate driving unit of a bth gate driving subcircuit to be the same as a type of an input signal in a first stage gate driving unit of a (b+1)th gate driving (Continued)

subcircuit, where B is an integer greater than 1 and b is a positive integer less than B.

18 Claims, 13 Drawing Sheets

(56) References Cited

U.S. PATENT DOCUMENTS

| | | | | |
|---|---|---|---|---|
| 2016/0117987 | A1* | 4/2016 | Byun | G09G 3/3266 345/205 |
| 2016/0372078 | A1 | 12/2016 | Song et al. | |
| 2017/0345365 | A1 | 11/2017 | Li | |
| 2018/0088654 | A1 | 3/2018 | Liu | |

FOREIGN PATENT DOCUMENTS

| | | | |
|---|---|---|---|
| CN | 104658466 | A | 5/2015 |
| CN | 106057855 | A | 10/2016 |
| CN | 106328081 | A | 1/2017 |
| CN | 108873521 | A | 11/2018 |
| CN | 108877632 | A | 11/2018 |
| CN | 108922491 | A | 11/2018 |

OTHER PUBLICATIONS

International Search Report dated Jan. 23, 2020, issued in counterpart application No. PCT/CN2019/111971. (10 pages).

* cited by examiner

GATE DRIVING CIRCUIT, GATE DRIVING METHOD, FOLDABLE DISPLAY PANEL, AND DISPLAY APPARATUS

CROSS-REFERENCE TO RELATED APPLICATIONS

This application claims benefit of the filing date of Chinese Patent Application No. 201910146362.4 filed on Feb. 27, 2019, the disclosure of which is hereby incorporated in its entirety by reference.

TECHNICAL FIELD

The present disclosure relates to display technologies, and in particular, to a gate driving circuit, a gate driving method, a foldable display panel, and a display apparatus

BACKGROUND

The existing foldable display panel includes B display areas arranged in order, where B is an integer greater than 1. The gate driving circuit used in the foldable display panel includes B gate driving subcircuits, and each gate driving subcircuit corresponds to a display area. B start signal lines are used in the current technology. Each start signal line provides a start signal to a gate driving subcircuit, thereby achieving separate control over the brightness of the screens.

BRIEF SUMMARY

One embodiment of the present disclosure is a gate driving circuit applied to a foldable display panel comprising B display areas arranged in order. The gate driving circuit may include B gate driving subcircuits and a control circuit. Each of the gate driving subcircuits may correspond to one of the display areas and each of the gate driving subcircuits may comprise a plurality of stage gate driving units. The control circuit may be configured to, when the foldable display panel is in a full screen display state, control a type of an input signal in a last stage gate driving unit of a bth gate driving subcircuit to be the same as a type of an input signal in a first stage gate driving unit of a (b+1)th gate driving subcircuit, where B is an integer greater than 1 and b is a positive integer less than B.

Optionally, a gate line connected to the last stage gate driving unit of the bth gate driving subcircuit may be adjacent to a gate line connected to the first stage gate driving unit in the (b+1)th gate driving subcircuit.

Optionally, the control circuit may comprise a signal supply circuit and B−1 control gate driving units. The signal supply circuit may be configured to, when the foldable display panel is in the full screen display state, provide a start signal to a first stage gate driving unit in a first gate driving subcircuit and start signals to the B−1 control gate driving units respectively; and a bth control gate driving unit may be connected to a first stage gate driving unit of the (b+1)th gate driving subcircuit, and may be configured to generate an input signal to the first stage gate driving unit of the (b+1)th gate driving subcircuit based on the start signal.

Optionally, the control gate driving unit may have a same structure as one of the gate driving units in the gate driving subcircuits.

Optionally, the input signal input to the first stage gate driving unit of the (b+1)th gate driving subcircuit may be a square wave signal having a step.

Optionally, the control circuit may comprise a scan direction control circuit. The scan direction control circuit may be configured to control scan directions of adjacent gate driving subcircuits to be opposite.

Optionally, the control circuit may further comprise a signal supply circuit. The scan direction control circuit may be configured to, when the foldable display panel is in the full screen display state, control a forward scan performed on the gate driving units in a (2a−1)th gate driving subcircuit, a backward scan performed on the gate driving units in a 2ath gate driving subcircuit, and a forward scan performed on the gate driving units in a (2a+1)th gate driving subcircuit, where 2a+1 is less than or equal to B and a is a positive integer. The signal supply circuit may be configured to, when the foldable display panel is in the full screen display state, provide start signals to the first stage gate driving unit in the (2a−1)th gate driving subcircuit, the last stage of the gate driving unit in the 2ath gate driving subcircuit, and the first stage gate driving unit in the (2a+1)th gate driving subcircuit, respectively.

Optionally, the number of stages of the gate driving units in the (2a−1)th gate driving subcircuit may be equal to the number of stages of the gate driving units in the 2ath gate driving subcircuit.

Optionally, the control circuit may further comprise a signal supply circuit. The scan direction control circuit may be configured to, when the foldable display panel is in the full screen display state, control a backward scan performed on the gate driving units in the (2a−1)th gate driving subcircuit, a forward scan performed on the gate driving units in the 2ath gate driving subcircuit, and a backward scan performed on the gate driving units in the (2a+1)th gate driving subcircuit, where 2a+1 is less than or equal to B and a is a positive integer. The signal supply circuit may be configured to, when the foldable display panel is in the full screen display state, provide start signals to the last stage gate driving unit in the (2a−1)th gate driving subcircuit, the first stage of the gate driving unit in the 2ath gate driving subcircuit, and the last stage gate driving unit in the (2a+1)th gate driving subcircuit, respectively.

Optionally, the number of stages of the gate driving units in the 2ath gate driving subcircuit may be equal to the number of stages of the gate driving units in the (2a+1)th gate driving subcircuit.

Optionally, the control circuit may comprise a signal supply circuit and B−1 on-off control circuits. A bth on-off control circuit may be respectively connected to a gate driving signal output terminal of the last stage gate driving unit in the bth gate driving subcircuit and an input terminal of the first stage gate driving unit in the (b+1)th gate driving subcircuit. The bth on-off control circuit may be configured to, when the foldable display panel is in the full-screen display state, perform control to turn on a connection between the gate driving signal output terminal of the last stage gate driving unit in the bth gate driving subcircuit and the input terminal of the first stage gate driving unit in the (b+1)th gate driving subcircuit. The signal supply circuit may be configured to, when the foldable display panel is in the full-screen display state, provide a first start signal to the first stage gate driving unit of the first gate driving subcircuit.

Optionally, the bth on-off control circuit may be further configured to, when the foldable display panel is in a split screen display state, perform control to turn off the connection between the gate driving signal output terminal of the last stage gate driving unit in the bth gate driving subcircuit and the input terminal of the first stage gate driving unit in the (b+1)th gate driving sub-circuit.

Optionally, the signal supply circuit may be further configured to, when the foldable display panel is in the split screen display state and a first display area is in a displaying state, provide the start signal to the first stage gate driving unit of the first gate driving subcircuit.

Optionally, the signal supply circuit may be further configured to, when the foldable display panel is in the split screen display state and a (b+1)th display area is in the displaying state, provide the start signal to the first stage gate driving unit of the (b+1)th gate driving subcircuit.

Optionally, the bth on-off control circuit may comprise a (2b−1)th control transistor and a 2bth control transistor, and the signal supply circuit comprises a (2b−1)th control signal terminal and a 2bth control signal terminal. A control terminal of the (2b−1)th control transistor may be connected to the (2b−1)th control signal terminal of the signal supply circuit, a first terminal of the (2b−1)th control transistor may be connected to a start signal output terminal of the signal supply circuit, and a second terminal of the (2b−1)th control transistor may be connected to the input terminal of the first stage gate driving unit in the (b+1)th gate driving subcircuit. A control terminal of the 2bth control transistor may be connected to the 2bth control signal terminal of the signal supply circuit, a first terminal of the 2bth control transistor may be connected to the gate driving signal output terminal of the last stage gate driving unit in the bth gate driving subcircuit, and a second terminal of the 2bth control transistor may be connected to the input terminal of the first stage gate driving unit in the (b+1)th gate driving subcircuit. The signal supply circuit may be further configured to: when the foldable display panel is in the split screen display state and the (b+1)th display area is in the displaying state, provide a (2b−1)th control signal through the (2b−1)th control signal terminal, a 2bth control signal through the 2b control signal terminal, and provide the start signal through the start signal output terminal.

Optionally, the type of the input signal in the last stage gate driving unit of the bth gate driving subcircuit may be a square wave signal having a step or a square wave signal having no step.

Optionally, each of the gate driving subcircuits may comprise a same number of stage gate driving units.

Another embodiment of the present disclosure is a gate driving method for driving the gate driving circuit. The method may comprise controlling the type of the input signal input to the last stage gate driving unit in the bth gate driving subcircuit to be the same as the type of the input signal input to the first stage gate driving unit in the (b+1)th gate driving subcircuit when the foldable display panel is in a full screen display state.

Another embodiment of the present disclosure is a foldable display panel comprising the gate driving circuit.

Another embodiment of the present disclosure is a display apparatus comprising the foldable display panel.

BRIEF DESCRIPTION OF THE DRAWINGS

The drawings are intended to provide a further understanding of the technical solutions of the present disclosure, and are intended to be a part of the specification, and are used to explain the technical solutions of the present disclosure, and do not constitute a limitation of the technical solutions of the present disclosure.

DETAILED DESCRIPTION

Figure 1:
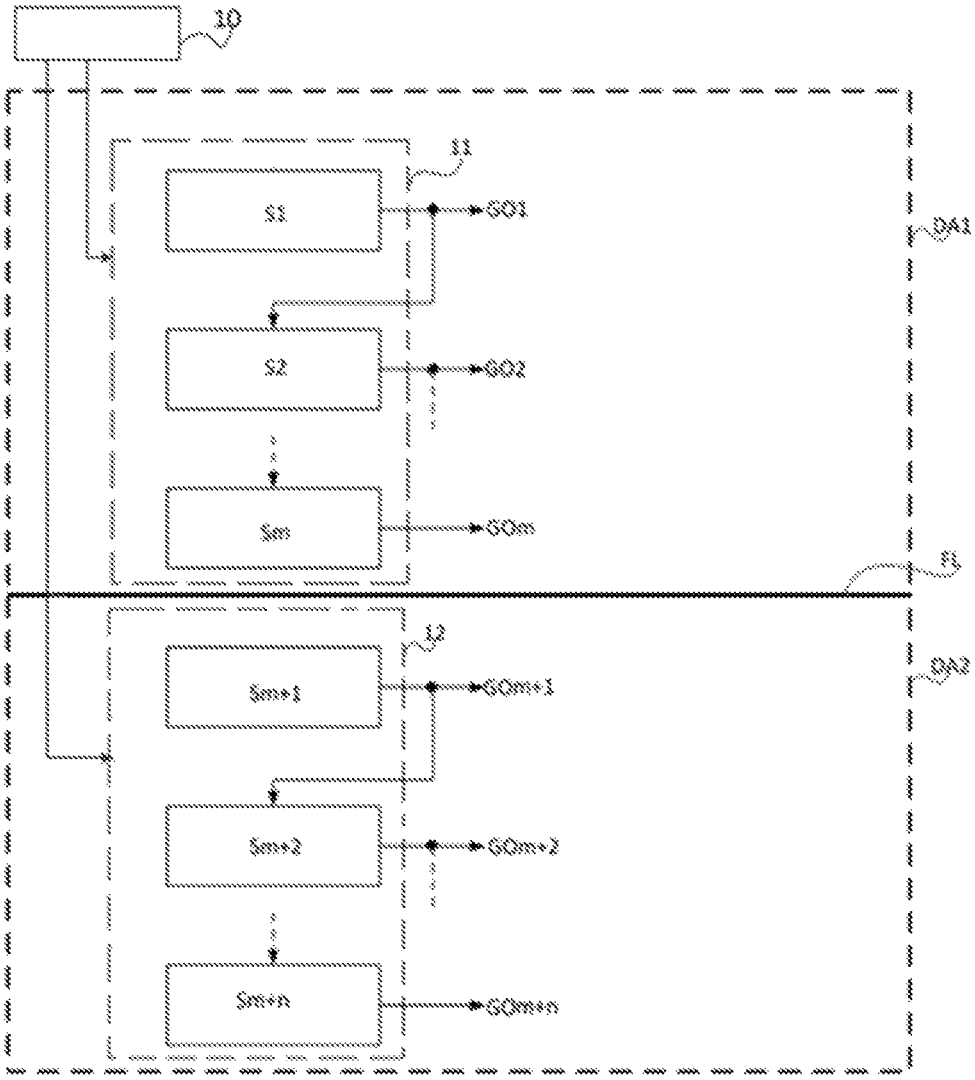
FIG. 1 is a schematic diagram of a gate driving circuit according to one embodiment of the present disclosure.

The present disclosure will be further described in detail with reference to the accompanying drawings. When referring to the figures, like structures and elements shown throughout are indicated with like reference numerals. Obviously, the described embodiments are only a part of the embodiments of the present disclosure, not all of the embodiments. All other embodiments obtained by a person of ordinary skill in the art based on the embodiments of the present disclosure without creative efforts are within the protection scope of the present disclosure. In the description of the following embodiments, specific features, structures, materials or characteristics may be combined in any suitable manner in any one or more embodiments or examples.

In the following description, numerous specific details are set forth in order to provide a thorough understanding of the present disclosure, but the present disclosure may also be implemented in other ways other than those described herein. Therefore, the scope of the disclosure is not limited by the specific embodiments disclosed below. The transistors in all embodiments of the present disclosure may each be a bipolar transistor, a thin film transistor or a field effect transistor or other device having the same or similar characteristics. In order to distinguish the two terminal of the transistor except the control terminal, one of the terminals is referred to as a first terminal, and the other terminal is referred to as a second terminal.

In operation, when the transistor is a bipolar junction transistor, the control terminal may be a base, the first terminal may be a collector, and the second terminal may be an emitter; or the control terminal may be a base, the first terminal may be an emitter and the second terminal may be a collector.

In operation, when the transistor is a thin film transistor or a field effect transistor, the control terminal may be a gate, the first terminal may be a drain, and the second terminal may be a source; or, the control terminal may be a gate, the first terminal may be a source, and the second terminal may be a drain.

When a foldable display panel performs a full screen displaying, the input signal input to the last row of the gate driving unit in the previous display area (the input signal may be a square wave signal having a step) may be very different from the input signal input to the first stage gate driving unit in the next display area (the input signal may be a square wave signal without a step). Such difference may lead to the significant difference of the gate driving signals output from the last stage gate driving unit in the previous display area and the first stage gate driving unit in the next display area, thereby causing screen splitting phenomenon in the full screen display state.

One embodiment of the present disclosure provides a gate driving circuit, which may be applied to a foldable display panel. The foldable display panel includes B display areas arranged in order, and the gate driving circuit includes a control circuit and B gate driving subcircuits. B is an integer greater than 1, and each gate driving subcircuit corresponds to a display area.

The control circuit is configured to control the type of an input signal input to the last stage gate driving unit of the bth gate driving subcircuit to be the same as the type of an input signal input to the first stage gate driving unit of the (b+1)th gate driving subcircuit when the foldable display panel is in a full screen display state.

b is a positive integer less than B.

In one embodiment of the present disclosure, the gate driving circuit employs a control circuit. The control circuit controls the type of the input signal input to the last stage gate driving unit of the bth gate driving subcircuit to be the same as the type of the input signal input to the first stage gate driving unit of the (b+1)th gate driving subcircuit when the foldable display panel is in the full screen display state. Thus, the difference of input signals between the last stage gate driving unit of the bth gate driving subcircuit and the first stage gate driving unit of the (b+1)th gate driving subcircuit is reduced, and accordingly the display difference is reduced at the boundaries between the bth display area and the (b+1)th display area, thereby improving the splitting screen phenomenon.

In one embodiment, the bth display area and the (b+1)th display area are located at two sides of the folding line of the foldable display panel.

In one embodiment, the same type of the two input signals may refer to the same type of the waveforms of the two input signals. For example, the two input signals may all be square wave signals having no step, or the two input signals may be both a square wave signal having a step, but are not limited hereto.

In operation, the two input signals may also be triangular wave signals, or the two input signals may also be pulse signals, and the like.

In one embodiment, the gate line connected to the last stage gate driving unit in the bth gate driving subcircuit is adjacent to the gate line connected to the first stage gate driving unit in the (b+1)th gate driving subcircuit.

In operation, the foldable display panel includes a plurality of display areas. When the foldable display panel is in the full screen display state, the plurality of display areas may display an image together. When the foldable display panel is in a split screen display state, at least one of the display areas may display an image separately.

The foldable display panel may be a two-fold display panel. That is, the foldable display panel may include three display areas and the second display area is disposed between the first display area and the third display area.

The foldable display panel may also be a three-fold display panel. That is, the foldable display panel may include four display areas, and the first display area, the second display area, the third display area, and the fourth display area arranged in order.

In one embodiment, the foldable display panel may include adjacent first and second display areas. The first gate driving subcircuit corresponding to the first display area is used to drive the gate lines from the first to the mth row in the foldable display panel (m is an integer greater than 1). The second gate driving subcircuit corresponding to the second display area is used to drive the gate lines from the (m+1)th to the (m+n)th row in the foldable display panel (n is an integer greater than 1).

As shown in FIG. 1, the foldable display panel includes adjacent first display area DA1 and second display area DA2 arranged in order from top to bottom. In one embodiment, the gate driving circuit includes a first gate driving subcircuit 11 and a second gate driving subcircuit 12. The first gate driving subcircuit 11 corresponds to the first display area DA1, and the second gate driving subcircuit 12 corresponds to the second display area DA2.

The first gate driving subcircuit 11 includes m stage gate driving units, where m is an integer greater than 1. FIG. 1 shows the first stage gate driving unit S1, the second stage gate driving unit S2, and the mth stage gate driving unit Sm.

The second gate driving subcircuit 12 includes n stage gate driving units, where n is an integer greater than 1. FIG. 1 shows the (m+1)th stage gate driving unit Sm+1, (m+2)th stage gate driving unit Sm+2, and the (m+n)th stage gate driving unit Sm+n.

In FIG. 1, the gate driving signal output terminal of S1 is labeled as GO1, connected to the first row gate line (not shown in FIG. 1) in the first display area. The gate driving signal output terminal of S2 is labeled as GO2, connected to the second row gate line (not shown in FIG. 1) in the first display area. The gate driving signal output terminal of Sm is labeled as GOm, connected to the mth row gate line in the first display area. The mth row gate line in the first display area is the last row gate line in the first display area, and the mth row gate line is not shown in FIG. 1.

In FIG. 1, the gate driving signal output terminal of Sm+1 is labeled as GOm+1, connected to the first row gate line (not shown in FIG. 1) in the second display area. The gate driving signal output terminal of Sm+2 is labeled as GOm+2, connected to the second row gate line (not shown in FIG. 1) in the second display area. The gate driving signal output terminal of Sm+n is labeled as GOm+n, connected to the nth row gate line in the second display area. The nth row gate line in the second display area is the last row gate line in the second display area, and the nth row gate line is not shown in FIG. 1.

In one embodiment, the gate driving circuit further includes a control circuit 10, configured to control the type of the first input signal input to Sm to be the same as the type of the second input signal input to Sm+1 when the foldable display panel is in the full screen display state.

In FIG. 1, the label FL is a folding line between the first display area DA1 and the second display area DA2.

In one embodiment, as shown in FIG. 1, the first display area DA1 is disposed above the second display area DA2, that is, the first display area DA1 is farther away from the driving integrated circuit (IC). The second display area DA2 is closer to the driving IC, and the driving IC is disposed at the lower side of the display panel.

In some embodiments, as an example, the driving IC is disposed at the lower side of the display panel. In actual operation, the driving IC may also be disposed at the upper side of the display panel. Thus, the first display area DA1 is closer to the driving IC, and the second display area DA2 is farther away from the driving IC.

In one embodiment, as shown in FIG. 1, GO1 is connected to the input terminal of S2. The gate driving signal output terminal in the previous stage gate driving unit included in the first gate driving subcircuit is connected to the input terminal of the adjacent next stage gate driving unit included in the first gate driving subcircuit. GOm+1 is connected to the input terminal of Sm+2. The gate driving signal output terminal in the previous stage gate driving unit in the second gate driving subcircuit is connected to the input terminal of the adjacent next stage gate driving unit in the second gate driving subcircuit.

In one embodiment, as shown in FIG. 1, the first display area DA1 and the second display area DA2 are disposed at two sides of the folding line FL, respectively.

In one embodiment, the first input signal and the second input signal may both be square wave signals having a step, or the first input signal and the second input signal may both be square wave signals having no step.

Figure 2:
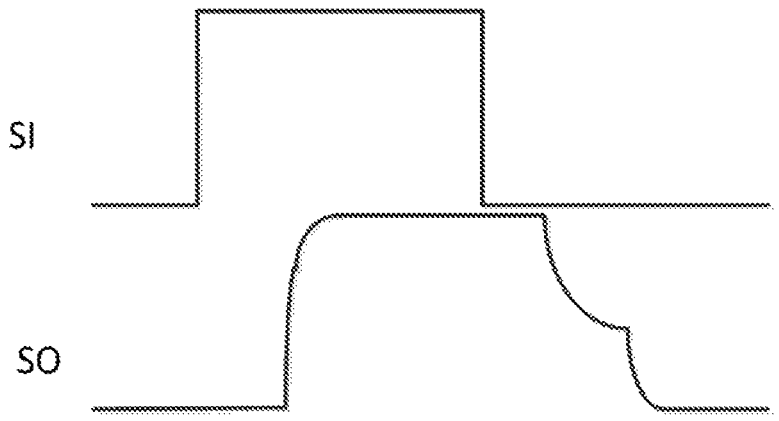
FIG. 2 shows a waveform of an input signal S1 and a waveform of an output signal SO.

In actual operation, whether a P-type TFT transmits a low potential or an N-type TFT transmits a high potential, there is a threshold loss. Taking the low potential of the P-type TFT as an example, FIG. 2 shows the waveform of the input signal S1 of the gate on array (GOA) unit, a gate driving circuit on an array substrate and the waveform of the output signal SO. Due to the threshold loss, the output signal may show a step and then be pulled down. The input signal of the next stage GOA unit is the same as the output signal of the previous stage GOA unit, that is, SO (SO, the input signal of the next stage GOA unit) is a square wave signal having a step. S1 is a square wave signal having no step.

A GOA unit including P-type TFTs outputs a square wave signal having a step is described below.

Figure 3:
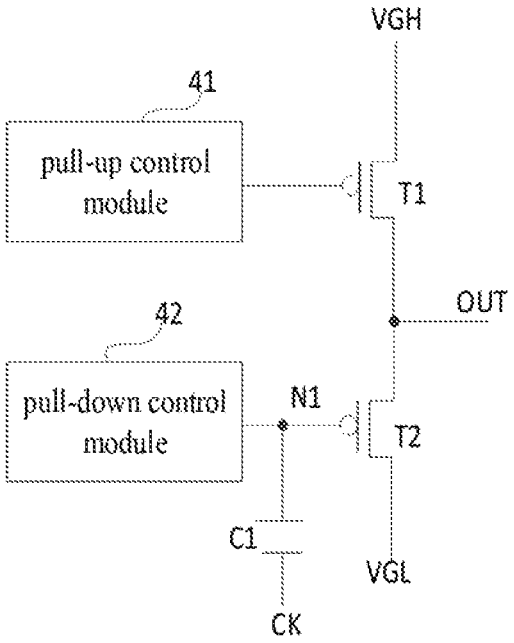
FIG. 3 is a schematic diagram of a gate driving circuit on an array substrate (GOA) unit including a P-type thin film transistor (TFT) according to one embodiment of the present disclosure.

As shown in FIG. 3, in one embodiment, a GOA unit including a P-type TFT includes a pull-up control module 41, a pull-down control module 42, a storage capacitor C1, a first transistor T1, and a second transistor T2 (T1 and T2 are both P-type TFT).

Also, the transistors included in the pull-up control module 41 and the transistors included in the pull-down control module 42 are both P-type TFTs.

In FIG. 3, the clock signal is labeled as CK, the gate driving signal output terminal of the GOA unit is labeled as OUT, the high voltage is labeled as VGH, the low voltage is labeled as VGL, and the pull-down node is labeled as N1.

In one embodiment, when the GOA unit in FIG. 3 is in operation and the gate driving signal output terminal OUT is pulling-down a potential of a gate driving signal, the pull-down control module 42 controls the potential of N1 to be VGL+|Vth| (Vth is the threshold voltage of the TFT in the pull-down control module 42, and this is caused by the threshold loss when the P-type TFT transmits the low level potential), and T2 is turned on. The potential of the gate driving signal output from OUT starts to pull down to VGL+|Vth2|+|Vth|, and T2 is turned off (Vth2 is the threshold voltage of T2).

At the same time, the potential of CK is VGH, and the voltage stored by the storage capacitor C1 between N1 and the input clock signal terminal of CK is VGL+|Vth|−VGH. The subsequent potential of CK will jump to VGL. Since the voltage across the storage capacitor C1 cannot change instantaneously, the potential of N1 will also be pulled down to a lower potential. T2 will be turned on again and transfer VGL to OUT without threshold loss. Therefore, there will be a step in the waveform of the output signal.

Figure 4:
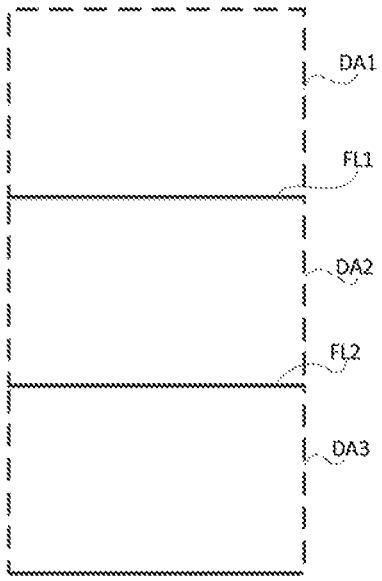
FIG. 4 is a schematic diagram of a foldable display panel including the first display area, the second display area, and the third display area disposed in order from top to bottom.

As shown in FIG. 4, when the foldable display panel includes three display areas, the foldable display panel includes a first display area DA1, a second display area DA2, and a third display area DA3 arranged in order from top to bottom. The gate driving circuit includes a first gate driving subcircuit corresponding to DA1 (not shown in FIG. 4), a second gate driving subcircuit corresponding to DA2 (not shown in FIG. 4), and a third gate driving subcircuit corresponding to DA3 (not shown in FIG. 4).

In FIG. 4, the label FL1 is the first folding line, and the label FL2 is the second folding line.

In one embodiment, as shown in FIG. 4, DA1 and DA2 are disposed at two sides of FL1, respectively and DA2 and DA3 are disposed at two sides of FL2, respectively.

The foldable display panel may include three display areas, and the second display area may be disposed between the first display area and the third display area.

Figure 5:
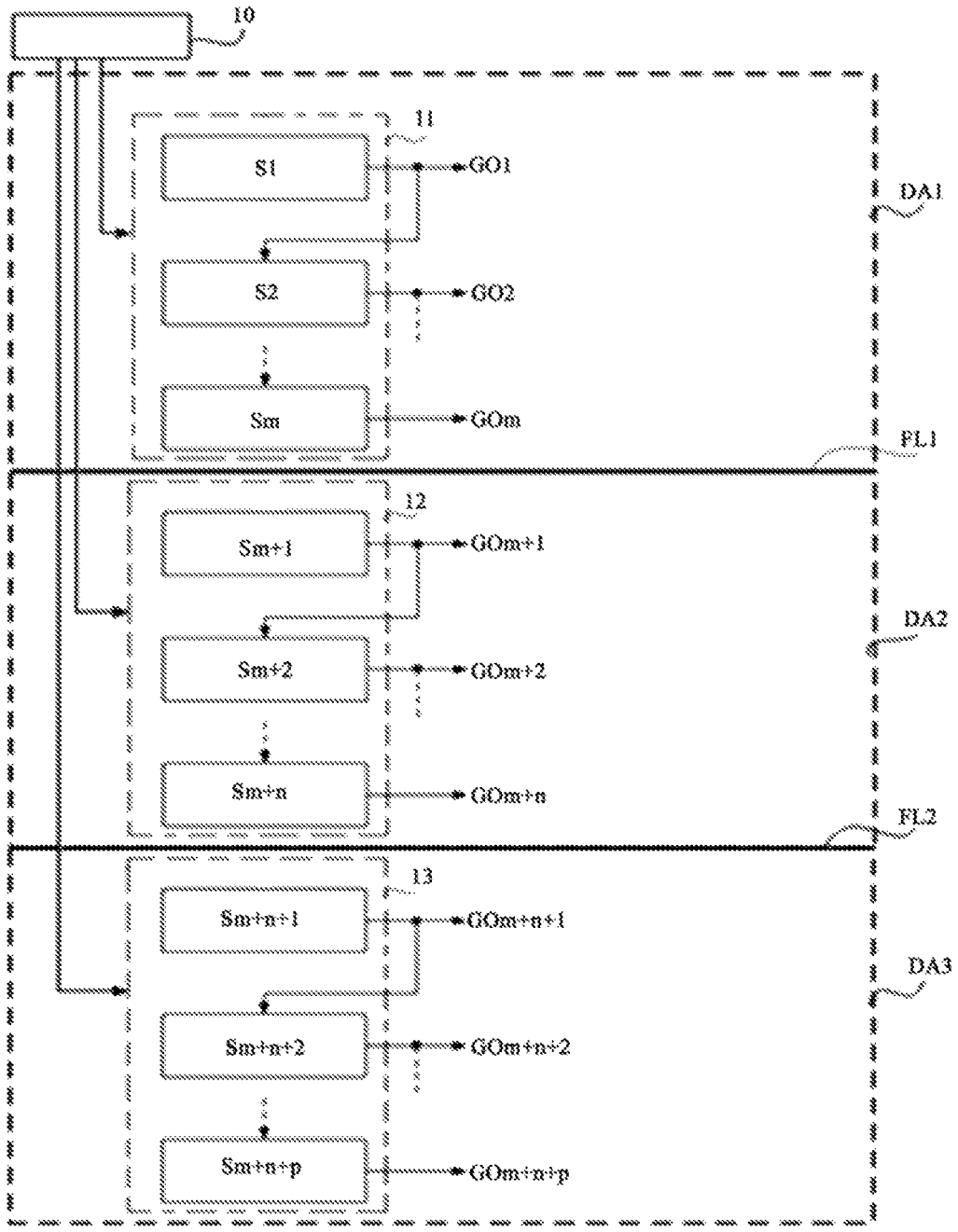
FIG. 5 is a schematic diagram of a gate driving circuit according to one embodiment of the present disclosure.

As shown in FIG. 5, the foldable display panel may include adjacent first display area DA1, second display area DA2, and third display area DA3 arranged in order from top to bottom. In one embodiment, the gate driving circuit includes a first gate driving subcircuit 11, a second gate driving subcircuit 12 and a third gate driving subcircuit 13. The first gate driving subcircuit 11 corresponds to the first display area DA1, the second gate driving subcircuit 12 corresponds to the second display area DA2, and the third gate driving subcircuit 13 corresponds to the third display area DA3.

The first gate driving subcircuit 11 includes m stage gate driving units, where m is an integer greater than 1. FIG. 5 shows the first stage gate driving unit S1, the second stage gate driving unit S2, and the mth stage gate driving unit Sm;

The second gate driving subcircuit 12 includes n stage gate driving units, where n is an integer greater than 1. FIG. 5 shows the (m+1)th stage gate driving unit Sm+1, (m+2)th stage gate driving unit Sm+2, and the (m+n)th stage gate driving unit Sm+n.

The third gate driving subcircuit 13 includes p stage gate driving units, where p is an integer greater than 1. FIG. 5 shows the (m+n+1)th gate driving unit Sm+n+1, (m+n+2)th gate driving unit Sm+n+2, and (m+n+p)th gate driving unit Sm+n+p.

In FIG. 5, the gate driving signal output terminal of S1 is labeled as GO1, connected to the first row gate line (not shown in FIG. 5) in DA3. The gate driving signal output terminal of S2 is labeled as GO2, connected to the second row gate line (not shown in FIG. 5) in DAL. The gate driving signal output terminal of Sm is labeled as label GOm, connected to the mth row gate line in DA1. The mth row gate line in DA1 is also the last row gate line in the first display area, and the mth row gate line is not shown in FIG. 5.

In FIG. 5, the gate driving signal output terminal of Sm+1 is labeled as GOm+1, connected to the first row gate line (not shown in FIG. 5) in DA2. The gate driving signal output terminal of Sm+2 is labeled as GOm+2, connected to the second row gate line (not shown in FIG. 5) in DA2. The gate driving signal output terminal of Sm+n is labeled as label GOm+n, connected to the nth row gate line in DA2. The nth row gate line in DA2 is also the last row gate line in DA2, and the nth row gate line is not shown in FIG. 5.

In FIG. 5, the gate driving signal output terminal of Sm+n+1 is labeled as GOm+n+1, connected to the first row gate line (not shown in FIG. 5) in DA3. The gate driving signal output terminal of Sm+n+2 is labeled as GOm+n+2, connected to the second row gate line (not shown in FIG. 5) in DA3. The gate driving signal output terminal of Sm+n+p is labeled as label GOm+n+p, connected to the pth row gate line in DA3. The pth row gate line in DA3 is also the last row gate line in DA3, and the pth row gate line is not shown in FIG. 5.

In one embodiment, the gate driving circuit further includes a control circuit 10, configured to control the type of the input signal input to Sm+1 to be the same as the type of the input signal input to Sm and also control the type of the input signal input to Sm+n to be the same as the type of the input signal input to Sm+n+1 when the foldable display panel is in the full screen display state. Therefore, the differences are reduced between the output gate driving signal of Sm+1 and the output gate driving signal of Sm and between the output gate driving signal of Sm+n and the output gate driving signal of Sm+n+1, thereby improving the screen splitting phenomenon.

In FIG. 5, the label FL1 is the first folding line between DA1 and DA2, and the label FL2 is the second folding line between DA2 and DA3.

In one embodiment, as shown in FIG. 5, GO1 is connected to the input terminal of S2. The gate driving signal output terminal in the previous stage gate driving unit in the first gate driving subcircuit is connected to the input terminal of the adjacent next stage gate driving unit in the first gate driving subcircuit. GOm+1 is connected to the input terminal of Sm+2. The gate driving signal output terminal in the previous stage gate driving unit in the second gate driving subcircuit is connected to the input terminal of the adjacent next stage gate driving unit in the second gate driving subcircuit. GOm+n+1 is connected to the input terminal of Sm+n+2. The gate driving signal output terminal in the previous stage gate driving unit in the third gate driving subcircuit is connected to the input terminal of the adjacent next stage gate driving unit in the third gate driving subcircuit.

In one embodiment, the control circuit may include a signal supply circuit and B−1 control gate driving units;

The signal supply circuit is configured to provide a start signal to the first stage gate driving unit in the first gate driving subcircuit when the foldable display panel is in the full-screen display state, and to provide start signals to the B−1 control gate driving units respectively.

The bth control gate driving unit is connected to the first stage gate driving unit of the (b+1)th gate driving subcircuit, and is configured to generate an input signal to the first stage gate driving unit of the (b+1)th gate driving subcircuit based on the start signal.

In one embodiment, the start signal provided to the first stage gate driving unit in the first gate driving sub-circuit and the start signal provided to the B−1 control gate driving units may be a square wave signal having no step. This is the start signal to the first stage gate driving unit in the first gate driving subcircuit when the foldable display panel is in the full-screen display state. Then, the input signal of the last stage gate driving unit in the first stage gate driving subcircuit is a square wave signal having a step.

In one embodiment, the structure of the control gate driving unit may be the same as or similar to that of the gate driving unit in the gate driving subcircuit to simplify the manufacturing process.

In actual operation, the input signal input to the first stage gate driving unit of the (b+1)th gate driving subcircuit may be a square wave signal having a step.

The bth control gate driving unit is a dummy gate driving unit. That is, the bth control gate driving unit accesses a start signal, generates an input signal based on the start signal, and provides the input signal to the first stage gate driving unit of the (b+1)th gate driving subcircuit. However, the bth control gate driving unit does not drive the gate line, and is only used to provide the input signal. The input signal of the first stage gate driving unit of the (b+1)th gate driving subcircuit is also a square wave signal having a step.

The signal supply circuit may be a data driving circuit disposed in a driving IC disposed at an upper side or a lower side of the foldable display panel, for providing a first start signal and a second start signal.

Figure 6:
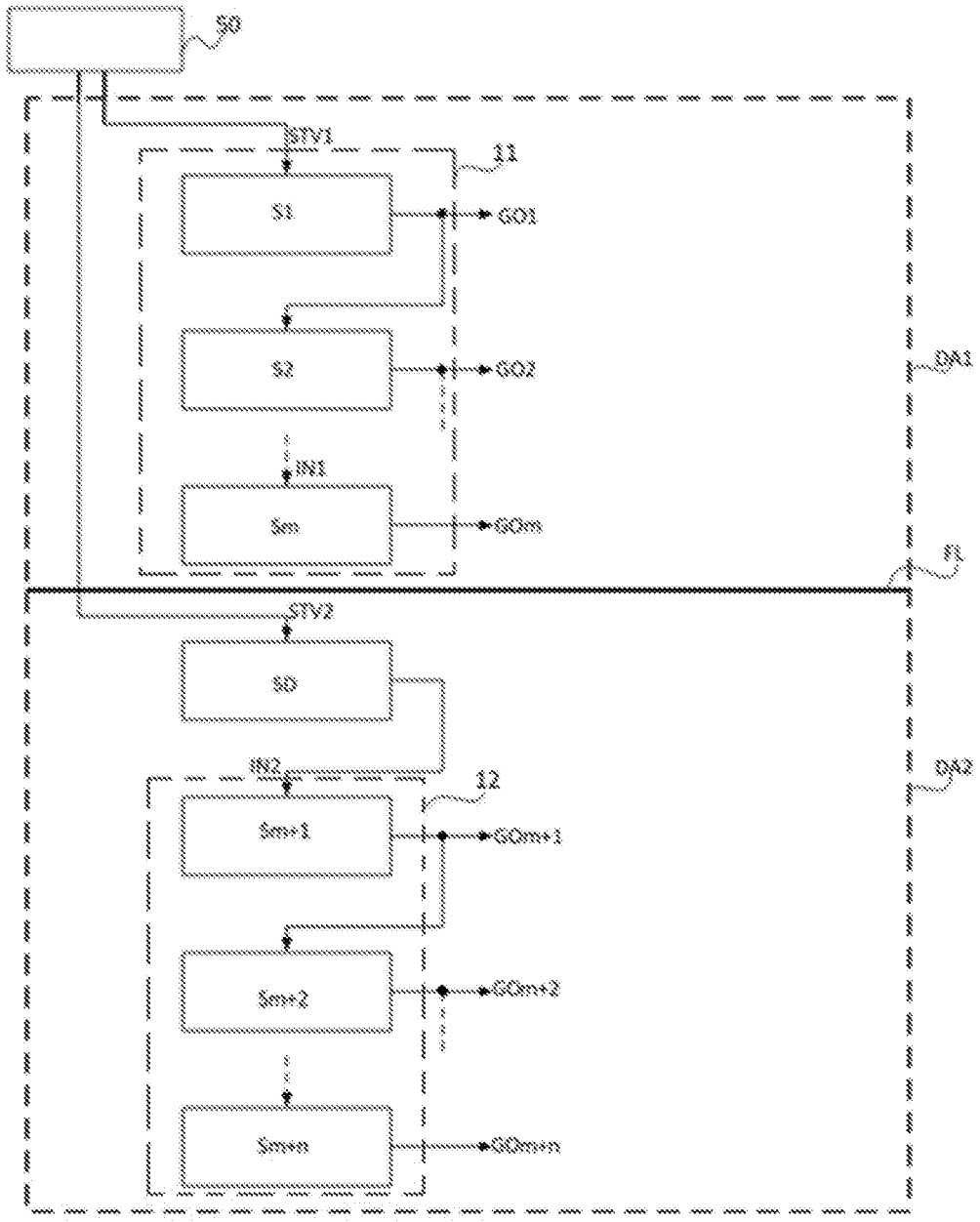
FIG. 6 is a schematic diagram of a gate driving circuit according to one embodiment of the present disclosure.

As shown in FIG. 6, on the basis of one embodiment of the gate driving unit shown in FIG. 1, the control circuit, in one embodiment, includes a signal supply circuit 50 and a control gate driving unit SD.

When the foldable display panel is in the full-screen display state, the signal supply circuit 50 is configured to provide a first start signal STV1 to S1. STV1 is a square wave signal having no step, and the second start signal STV2 is provided to the input terminal of SD, STV2 is also a square wave signal having no step.

The gate driving signal output terminal in the control gate driving unit SD is connected to the input terminal of Sm+1. The control gate driving unit SD is configured to output the second input signal IN2 based on STV1 to the input terminal of Sm+1 through the gate driving signal output terminal.

The gate driving signal output terminal in the (m−1)th stage gate driving unit (not shown in FIG. 6) of the first gate driving subcircuit 11 is connected to the input terminal of Sm. The (m−1)th stage gate driving unit (not shown in FIG. 6) outputs the first input signal IN1 to the input terminal of Sm through the gate driving signal output terminal.

The first input signal IN1 and the second input signal IN2 are both square wave signals having a step, so that the difference between the gate driving signal output from Sm and the gate driving signal output from Sm+1 can be reduced, thereby improving the screen splitting phenomenon.

In one embodiment, when the foldable display panel includes the first display area, the second display area, and the third display area arranged in order from top to bottom, the gate driving circuit includes the first gate driving subcircuit corresponding to the first display area, the second gate driving subcircuit corresponding to the second display area, and the third gate driving subcircuit corresponding to the third display area. The control circuit may include the signal supply circuit, the first control gate driving unit, and the second control gate driving unit.

When the foldable display panel is in the full-screen display state, the signal supply circuit is configured to provide the first start signal to the first stage gate driving unit in the first gate driving subcircuit, the second start signal to the first control gate driving unit, and the third start signal to the second control gate driving unit.

The first control gate driving unit is configured to generate an input signal input to the first stage gate driving unit in the second gate driving subcircuit based on the second start signal.

The second control gate driving unit is configured to generate an input signal input to the first stage gate driving unit in the third gate driving subcircuit based on the third start signal.

Figure 7:
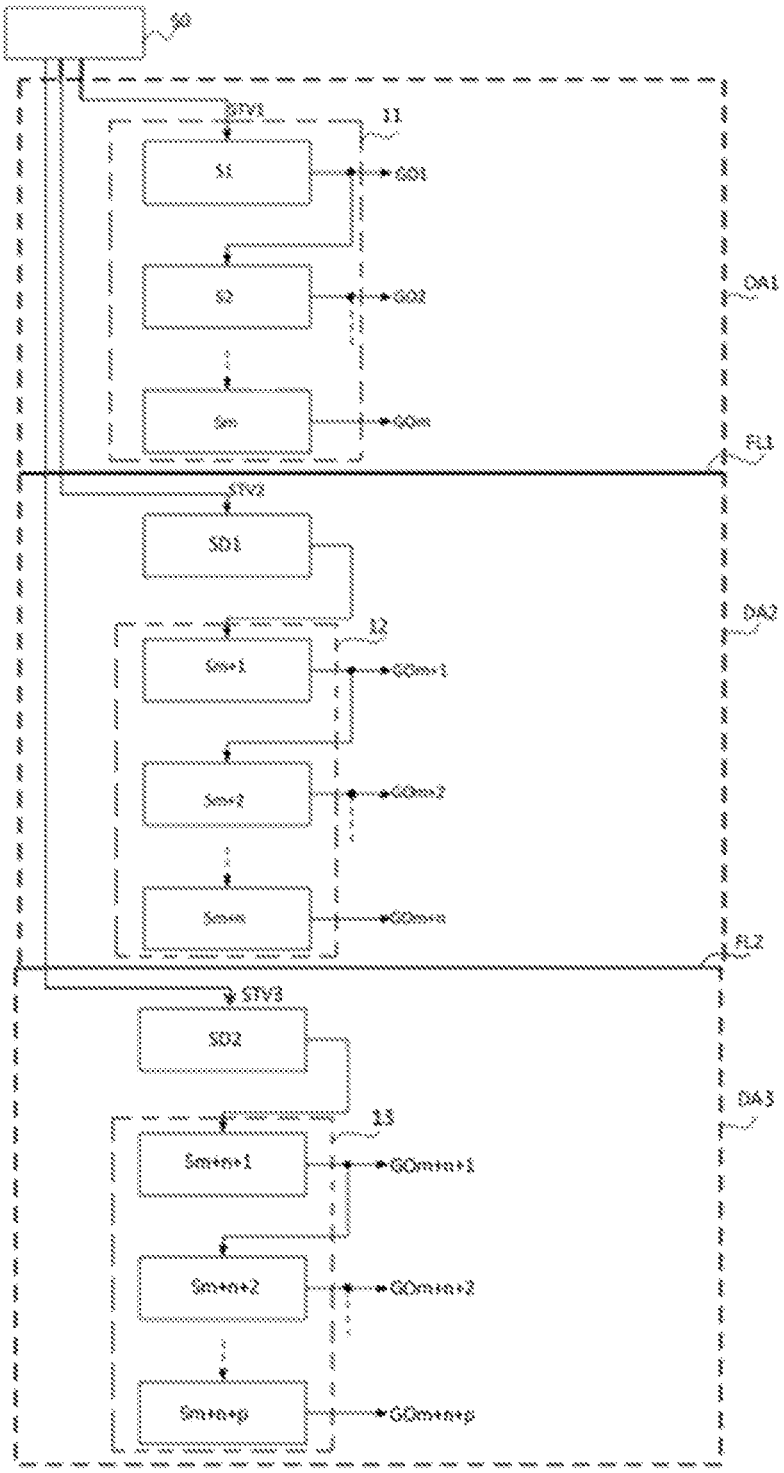
FIG. 7 is a schematic diagram of a gate driving circuit according to one embodiment of the present disclosure.

As shown in FIG. 7, on the basis of one embodiment of the gate driving unit shown in FIG. 5, the control circuit, in one embodiment, includes a signal supply circuit 50, a first control gate driving unit SD1, and a second control gate driving unit SD2.

When the foldable display panel is in the full-screen display state, the signal supply circuit 50 is configured to provide the first start signal STV1 to the first stage gate driving unit (i.e., S1) in the first gate driving subcircuit 11, the second start signal STV2 to the first control gate driving unit SD1, and the third start signal STV3 to the second control gate driving unit SD2.

The first control gate driving unit SD1 is configured to generate an input signal input to the first stage gate driving unit (i.e., Sm+1) in the second gate driving subcircuit 12 based on the second start signal STV2.

The second control gate driving unit SD2 is configured to generate an input signal input to the first stage gate driving unit (i.e., Sm+n+1) in the third gate driving subcircuit 13 based on the third start signal STV3.

In one embodiment of the gate driving unit shown in FIG. 7, STV1, STV2, and STV3 may all be square wave signals having no step, and the input signal output from SD1 to Sm+1 may be a square wave signal having a step. The input signal of Sm+n+1 output from SD2 may be a square wave signal having a step. In such way, the type of the input signal input to Sm+1 is controlled to be the same as the type of the input signal input to Sm, and the type of the input signal input to Sm+n is controlled to be the same as the type of the input signal input to Sm+n+1.

In one embodiment, the control circuit may include a scan direction control circuit.

The scan direction control circuit is configured to control scan directions of adjacent gate driving subcircuits to be opposite.

In one embodiment, the scan direction control circuit controls the scan directions of the adjacent gate driving subcircuits to be opposite so as to control the type of input signal in the last stage gate driving unit of the bth gate driving subcircuit to be the same as the type of input signal in the first stage gate driving unit of the (b+1)th gate driving subcircuit. The difference of input signals between the last stage gate driving unit of the bth gate driving subcircuit and the first stage gate driving unit of the (b+1)th gate driving subcircuit is reduced, and the display difference is reduced at the boundaries between the bth display area and the (b+1)th display area, thereby improving the screen splitting phenomenon.

In one embodiment, the scan direction control circuit may be a control chip disposed in the driving IC, and may control the scan direction by controlling a forward scan control voltage inputted from a forward scan control voltage terminal in the gate driving unit and by a backward scan control voltage inputted from a backward scan control voltage terminal in the gate driving unit. For example, when the forward scan control voltage is a valid voltage and the backward scan control voltage is an invalid voltage, the scan direction control circuit controls a forward scan. When the forward scan control voltage is an invalid voltage and the backward scan control voltage is a valid voltage, the scan direction control circuit controls a backward scan.

In one embodiment, the valid voltage is the voltage applying to the gate that can turn on the transistor. For example, when the transistor is an N-type transistor, the valid voltage is a high voltage. The invalid voltage is the voltage applying to the gate that can turn off the transistor. For example, when the transistor is an N-type transistor, the invalid voltage is a low voltage.

In one embodiment, the control circuit may further include a signal supply circuit.

When the foldable display panel is in the full-screen display state, the scan direction control circuit is configured to control the forward scan performed on each gate driving unit in the (2a−1)th gate driving subcircuit, the backward scan performed on each gate driving unit in the 2ath gate driving subcircuit, and the forward scan performed on each gate driving unit in the (2a+1)th gate driving subcircuit, where 2a+1 is less than or equal to B and a is a positive integer;

When the foldable display panel is in the full-screen display state, the signal supply circuit is configured to provide a start signal to the first stage gate driving unit in the (2a−1)th gate driving subcircuit, to the last stage of the gate driving unit in the 2ath gate driving subcircuit, and to the first stage gate driving unit in the (2a+1)th gate driving subcircuit, respectively.

In one embodiment, the start signal may be a square wave signal having no step. When the foldable display panel is in the full screen display state, the forward scan is performed on each gate driving unit in the (2a−1)th gate driving subcircuit, where the input signal input to the last stage gate driving unit in the (2a−1)th gate driving sub-circuit is a square wave signal having a step. The backward scan is performed on each gate driving unit in the 2ath gate driving subcircuit, where the input signal input to the first stage gate driving unit in the 2ath gate driving subcircuit is also a square wave signal having a step.

In one embodiment, the signal supply circuit may be a data driving circuit in a driving IC disposed at an upper side or a lower side of the foldable display panel for providing a start signal.

In one embodiment, the number of stages of the gate driving units in the (2a−1)th gate driving subcircuit is equal to the number of stages of the gate driving units in the 2ath gate driving subcircuit to ensure the same output delay in the gate driving signals output from the last stage gate driving unit in the (2a−1)th gate driving subcircuit and from the first stage gate driving unit in the 2ath gate driving subcircuit. As such, the display difference does not occur at the boundary between the 2a−1 display area and the 2a display area, and the screen splitting phenomenon is improved.

In one embodiment, the control circuit may further include a signal supply circuit.

When the foldable display panel is in the full-screen display state, the scan direction control circuit is configured to control the backward scan performed on each gate driving unit in the (2a−1)th gate driving subcircuit, the forward scan performed on each gate driving unit in the 2ath gate driving subcircuit, and the backward scan performed on each gate driving unit in the (2a+1)th gate driving subcircuit, where 2a+1 is less than or equal to B and a is a positive integer.

When the foldable display panel is in the full-screen display state, the signal supply circuit is configured to provide the start signals to the last stage gate driving unit in the (2a−1)th gate driving subcircuit, the first stage of the gate driving unit in the 2ath gate driving subcircuit, and the last stage gate driving unit in the (2a+1)th gate driving subcircuit.

In one embodiment, the start signal may be a square wave signal having no step. When the foldable display panel is in the full screen display state, the forward scan is performed on each gate driving unit in the 2ath gate driving subcircuit, where the input signal input to the last stage gate driving unit in the 2ath gate driving subcircuit is a square wave signal having a step. The backward scan is performed on each gate driving unit in the (2a+1)th gate driving subcircuit, where the input signal input to the first stage gate driving unit in the (2a+1)th gate driving subcircuit is also a square wave signal having a step.

In one embodiment, the number of stages of the gate driving units in the 2ath gate driving subcircuit is equal to the number of stages of the gate driving units in the (2a+1)th gate driving subcircuit to ensure the same output delay in the gate driving signals output from the last stage gate driving unit in the 2ath gate driving subcircuit and from the first stage gate driving unit in the (2a+1)th gate driving subcircuit. As such, the display difference does not occur at the boundary between the 2a display area and the 2a+1 display area, and the screen splitting phenomenon is improved.

Figure 8:
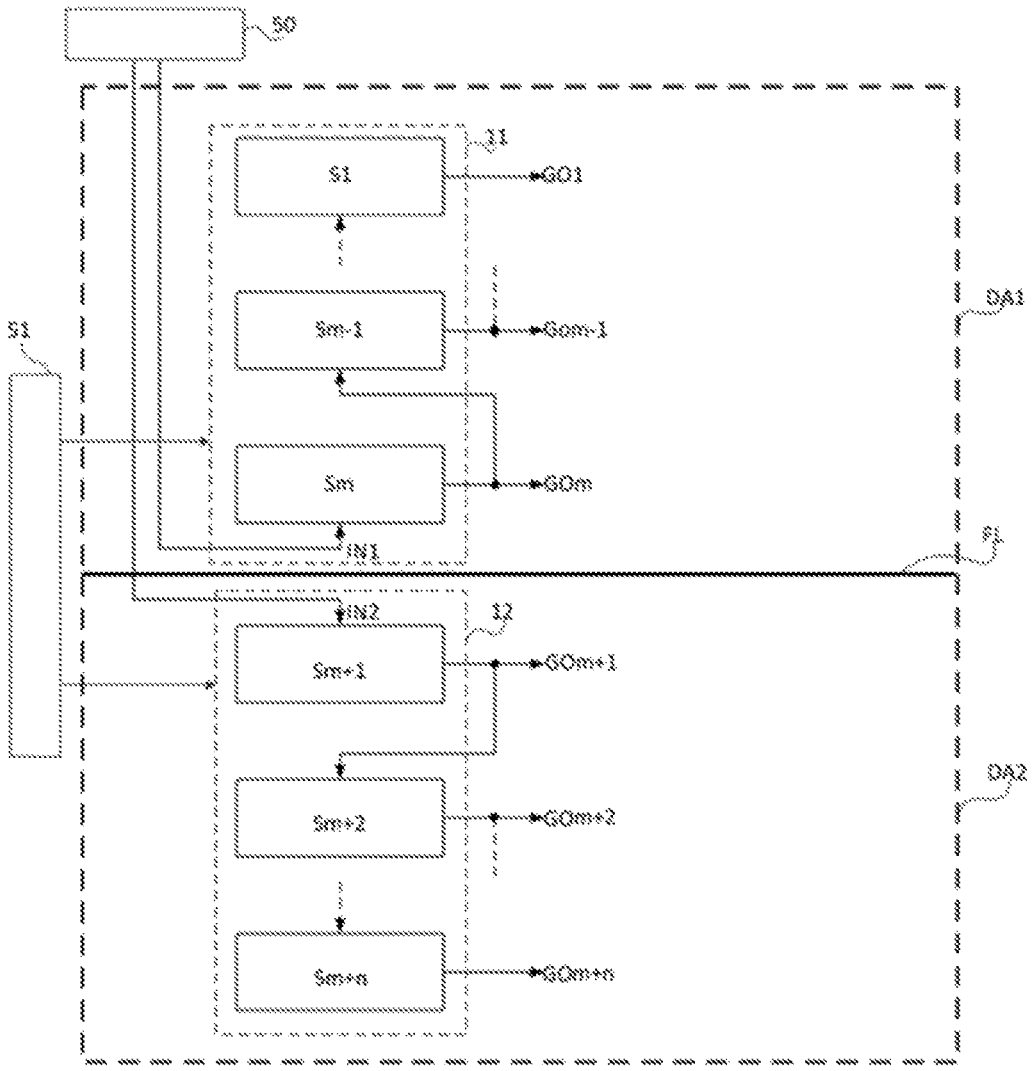
FIG. 8 is a schematic diagram of a gate driving circuit according to one embodiment of the present disclosure.

As shown in FIG. 8, the foldable display panel includes adjacent first display area DA1 and second display area DA2 arranged in order from top to bottom. In one embodiment, the gate driving circuit includes a first gate driving subcircuit 11 and a second gate driving subcircuit 12. The first gate driving subcircuit 11 corresponds to the first display area DA1, and the second gate driving subcircuit 12 corresponds to the second display area DA2.

The first gate driving subcircuit 11 includes m stage gate driving units, where m is an integer greater than 1. FIG. 8 shows the first stage gate driving unit S1 and the (m−1)th stage gate driving unit Sm−1, and mth stage gate driving unit Sm.

The second gate driving subcircuit 12 includes n stage gate driving units, where n is an integer greater than 1. FIG. 8 shows the (m+1)th stage gate driving unit Sm+1, (m+2)th stage gate driving unit Sm+2, and the (m+n)th stage gate driving unit Sm+n.

In FIG. 8, the gate driving signal output terminal of S1 is labeled as GO1, connected to the first row gate line (not shown in FIG. 8) in the first display area. The gate driving signal output terminal of Sm−1 is labeled as GOm−1, connected to the (m−1)th row gate line (not shown in FIG. 8) in the first display area DA1. The gate driving signal output terminal of Sm is labeled as GOm, connected to the mth row gate line in the first display area DA1. The mth row gate line in the first display area DA1 is the last row gate line in the first display area DA1, and the mth row gate line is not shown in FIG. 8.

In FIG. 8, the gate driving signal output terminal of Sm+1 is labeled as GOm+1, connected to the first row gate line (not shown in FIG. 8) in the second display area DA2. The gate driving signal output terminal of Sm+2 is labeled as GOm+2, connected to the second row gate line (not shown in FIG. 8) in the second display area DA2. The gate driving signal output terminal of Sm+n is labeled as GOm+n, connected to the nth row gate line in the second display area DA2. The nth row gate line in the second display area DA2 is the last row gate line in the second display area, and the nth row gate line is not shown in FIG. 8.

In FIG. 8, GOm is connected to the input terminal of Sm−1, and the output terminal of the next stage gate driving signal in the first gate driving subcircuit 11 is connected to the input terminal of the adjacent previous stage gate driving unit in the first gate driving subcircuit 11.

In FIG. 8, GOm+1 is connected to the input terminal of Sm+2, and the gate driving signal output terminal of the previous stage gate driving unit in the second gate driving subcircuit 12 is connected to the input terminal of the adjacent next stage gate driving unit in the second gate driving subcircuit 12.

In one embodiment, the gate driving circuit further includes a control circuit.

The control circuit includes a signal supply circuit 50 and a scan direction control circuit 51.

When the foldable display panel is in the full-screen display state, the scan direction control circuit 51 is configured to control the backward scan performed on each gate driving unit in the first gate driving subcircuit 11, that is, control the scan from the last stage gate driving unit of the first gate driving subcircuit 11 (i.e., Sm) to the first stage gate driving unit of the first gate driving subcircuit 11 (i.e., S1).

When the foldable display panel is in the full-screen display state, the scan direction control circuit 51 is configured to control the forward scan performed on each gate driving unit in the second gate driving subcircuit 12, that is, control the scan from the first stage gate driving unit of the second gate driving subcircuit 12 (i.e., Sm+1) to the last stage gate driving unit of the second gate driving subcircuit 12 (i.e., Sm+n).

When the foldable display panel is in the full-screen display state, the signal supply circuit 50 is configured to provide the first input signal IN1 to Sm and the second input signal IN2 to Sm+1. The first input signal IN1 and the second input signal IN2 may both be square wave signals having no step, such that the gate driving signals output from Sm and Sm+1 have the same delay, thereby not causing the display difference at the boundary between the first display area DA1 and the second display area DA2 and improving the screen splitting phenomenon.

Figure 9:
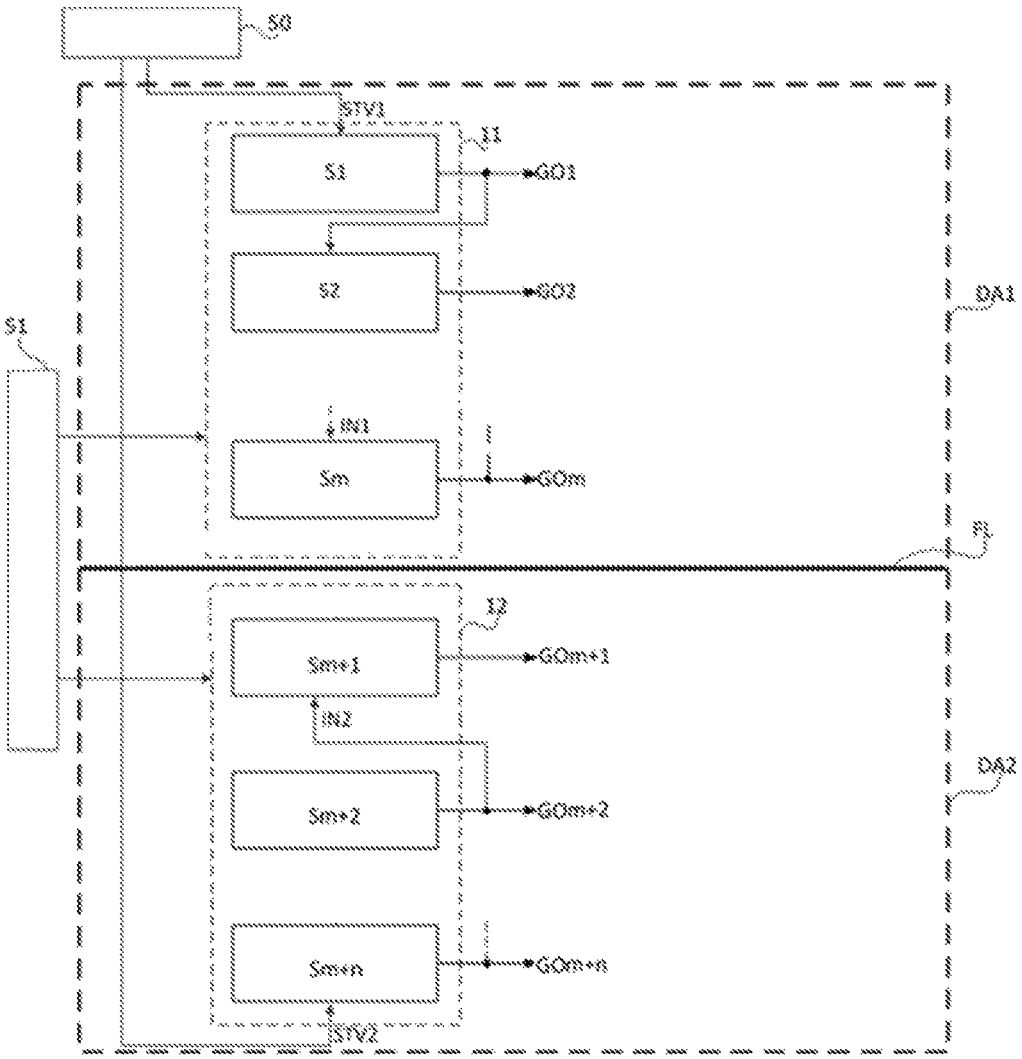
FIG. 9 is a schematic diagram of a gate driving circuit according to one embodiment of the present disclosure.

As shown in FIG. 9, the foldable display panel includes adjacent first display area DA1 and second display area DA2 arrange in order from top to bottom. In one embodiment, the gate driving circuit includes a first gate driving subcircuit 11 and a second gate driving subcircuit 12. The first gate driving subcircuit 11 corresponds to the first display area DA1, and the second gate driving subcircuit 12 corresponds to the second display area DA2.

The first gate driving subcircuit 11 includes in stage gate driving units, where m is an integer greater than 1. FIG. 9 shows the first stage gate driving unit S1, the second stage gate driving unit S2, and the mth stage gate driving unit Sm.

The second gate driving subcircuit 12 includes n stage gate driving units, where n is an integer greater than 1. FIG. 9 shows the (m+1)th stage gate driving unit Sm+1, (m+2)th stage gate driving unit Sm+2, and the (m+n)th stage gate driving unit Sm+n.

In FIG. 9, the gate driving signal output terminal of S1 is labeled as GO1, connected to the first row gate line (not shown in FIG. 9) in the first display area DAL. The gate driving signal output terminal of S2 is labeled as GO2, connected to the second row gate line (not shown in FIG. 9) in the first display area DA1. The gate driving signal output terminal of Sm is labeled as GOm, connected to the mth row gate line in the first display area DAL. The mth row gate line in the first display area DA1 is the last row gate line in the first display area DA1, and the mth row gate line is not shown in FIG. 9.

In FIG. 9, the gate driving signal output terminal of Sm+1 is labeled as GOm+1, connected to the first row gate line (not shown in FIG. 9) in the second display area DA2. The gate driving signal output terminal of Sm+2 is labeled as GOm+2, connected to the second row gate line (not shown in FIG. 9) in the second display area DA2. The gate driving signal output terminal of Sm+n is labeled as GOm+, connected to the nth row gate line in the second display area DA2. The nth row gate line in the second display area DA2 is the last row gate line in the second display area DA2, and the nth row gate line is not shown in FIG. 9.

In FIG. 9, GO1 is connected to the input terminal of S2, and the gate driving signal output terminal of the previous stage gate driving unit in the first gate driving subcircuit 11 is connected to the input terminal of the adjacent next stage gate driving unit in the first gate driving subcircuit.

In FIG. 9, GOm+n is connected to the input terminal of the (n−1)th stage gate driving unit (not shown in FIG. 9) in the second gate driving subcircuit 12. GOm+2 is connected to the input terminal of Sm+1. The output terminal of the e next stage gate driving unit in the second gate driving subcircuit 12 is connected to the input terminal of the adjacent previous stage gate driving unit in the second gate driving subcircuit 12.

In one embodiment, the gate driving circuit further includes a control circuit.

The control circuit includes a signal supply circuit 50 and a scan direction control circuit 51.

When the foldable display panel is in the full-screen display state, the scan direction control circuit 51 is configured to control the backward scan performed on each gate driving unit in the second gate driving subcircuit 12, that is, control the scan from the last stage gate driving unit of the second gate driving subcircuit 12 (i.e., Sm+n) to the first stage gate driving unit of the second gate driving subcircuit 12 (i.e., Sm+1).

When the foldable display panel is in the full-screen display state, the scan direction control circuit 51 is configured to control the forward scan performed on each gate driving unit in the first gate driving subcircuit 11, that is, control the scan from the first stage gate driving unit of the first gate driving subcircuit 11 (i.e., S1) to the last stage gate driving unit of the first gate driving subcircuit 11 (i.e., Sm+n).

When the foldable display panel is in the full-screen display state, the signal supply circuit 50 is configured to provide the first start signal STV1 to S1 and the second start signal STV2 to Sm+n. The first start signal STV1 and the second start signal STV2 may both be square wave signals having no step. The first input signal IN1 input to Sm is provided by the gate driving signal output terminal in the (m−1)th stage gate driving unit of the first gate driving subcircuit 11. The second input signal IN2 input to Sm+1 is provided by the gate driving signal output terminal in the Sm+2 stage gate driving unit of the second gate driving subcircuit 12. Thus, the first input signal IN1 input to Sm and the second input signal IN2 input to Sm+1 are both square wave signals having a step, thereby reducing the display difference between the gate driving signals output from Sm and Sm+1 and improving the screen splitting phenomenon.

In FIG. 9, the label FL is a folding line between the first display area DA1 and the second display area DA2.

In one embodiment, the number of stages of the gate driving units in the first gate driving subcircuit 11 is equal to the number of stages of the gate driving units in the second gate driving subcircuit 12, that is, m is equal to n, to ensure that the output delays of the upper and lower row gate driving units at the folding line FL are the same. Such that, the display difference does not occur at the boundary between the first display area and the second display area, and the screen splitting phenomenon is improved.

When the foldable display panel includes a plurality of display areas, some embodiments may control the scan directions of the adjacent two display areas to be opposite. In one embodiment, the gate driving subcircuit corresponding to each display area includes the same number of stages of the gate driving units.

In one embodiment, the foldable display panel includes a first display area, a second display area, and a third display area arranged in order from top to bottom, and the gate driving circuit includes a first gate driving subcircuit corresponding to the first display area, a second gate driving subcircuit corresponding to the second display area, and a third gate driving subcircuit corresponding to the third display area. The forward scans may be performed on multiple stage gate driving units in the first gate driving subcircuit. The backward scan may be performed on multiple stage gate driving units in the second gate driving subcircuit. The forward scan may be performed on multiple stage gate driving units in the third gate driving subcircuit. The number of stages of the gate driving units in the first gate driving subcircuit is equal to the number of stages of the gate driving units in the second gate driving subcircuit.

In one embodiment, the foldable display panel includes a first display area, a second display area, and a third display area which are disposed in order from top to bottom, and the gate driving circuit includes a first gate driving subcircuit corresponding to the first display area, a second gate driving subcircuit corresponding to the second display area, and a third gate driving subcircuit corresponding to the third display area. The backward scan may be performed on multiple stage gate driving units in the first gate driving subcircuit. The forward scan may be performed on multiple stage gate driving units in the second gate driving subcircuit. The backward scan may be performed on multiple stage gate driving units in the third gate driving subcircuit. The number of stages of the gate driving units in the second gate driving subcircuit is equal to the number of stages of the gate driving units in the third gate driving subcircuit.

In one embodiment, the control circuit may include a signal supply circuit and a scan direction control circuit.

When the foldable display panel is in the full-screen display state, the scan direction control circuit is configured to control the backward scan performed on each gate driving unit in the first gate driving subcircuit, the forward scan performed on each gate driving unit in the second gate driving subcircuit, and the backward scan performed on each gate driving unit in the third gate driving subcircuit.

When the foldable display panel is in the full-screen display state, the signal supply circuit is configured to provide the input signal to the last stage gate driving unit in the first gate driving subcircuit, the input signal to the first stage of the gate driving unit in the second gate driving subcircuit, and the start signal to the last stage gate driving unit in the third gate driving subcircuit.

In one embodiment, the number of stages of the gate driving units in the second gate driving subcircuit may be equal to the number of stages of the gate driving units in the third gate driving subcircuit.

Figure 10:
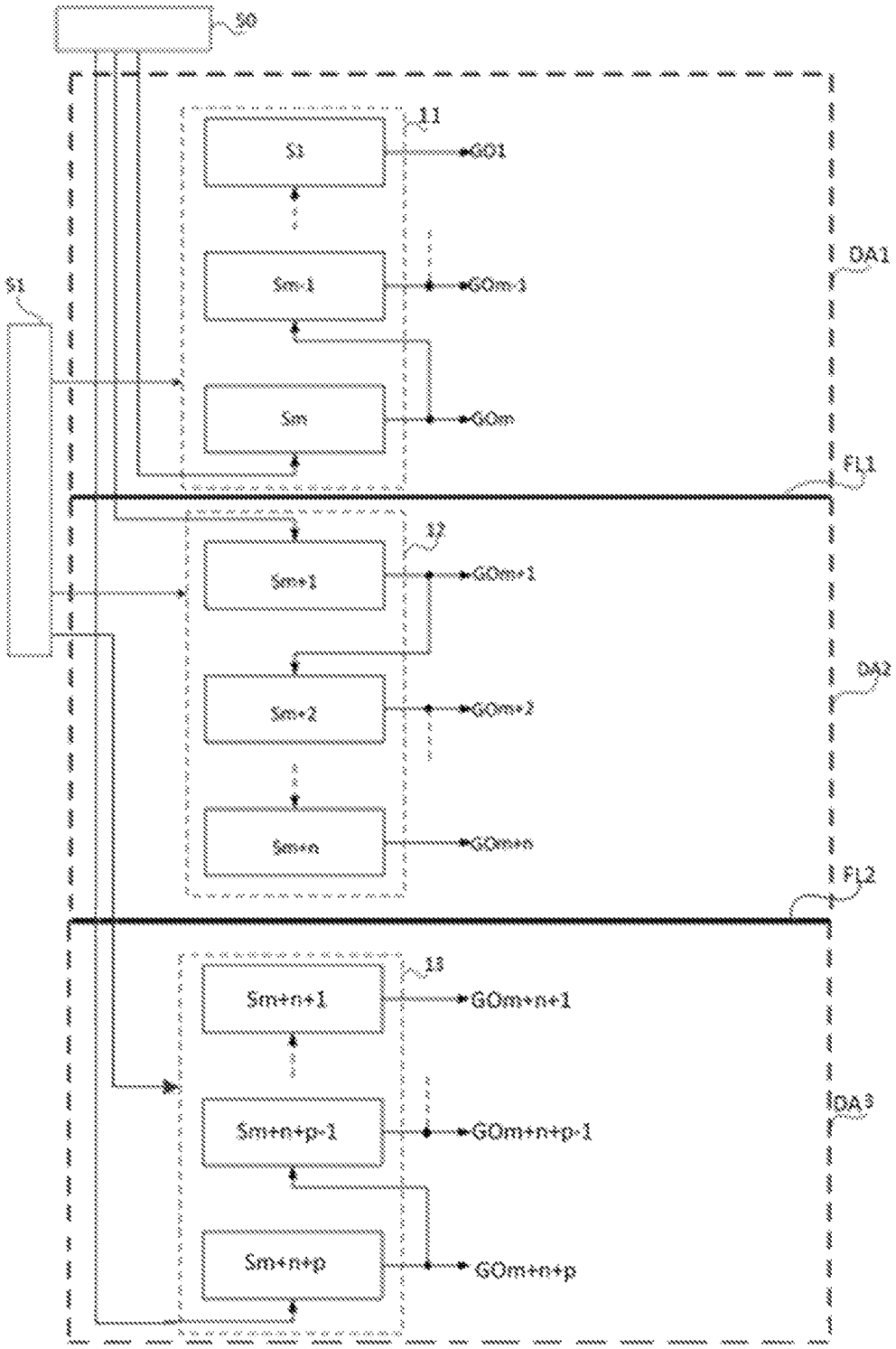
FIG. 10 is a schematic diagram of a gate driving circuit according to one embodiment of the present disclosure.

As shown in FIG. 10, the foldable display panel may include adjacent first display area DA1, second display area DA2, and third display area DA3 disposed in order from top to bottom. In one embodiment, the gate driving circuit includes a first gate driving subcircuit 11, a second gate driving subcircuit 12 and a third gate driving subcircuit 13. The first gate driving subcircuit 1 corresponds to the first display area DA1, the second gate driving subcircuit 12 corresponds to the second display area DA2, and the third gate driving subcircuit 13 corresponds to the third display area DA3.

The first gate driving subcircuit 11 includes m stage gate driving units, where m is an integer greater than 1. FIG. 10 shows the first stage gate driving unit S1, the second stage gate driving unit S2, and the mth stage gate driving unit Sm.

The second gate driving subcircuit 12 includes n stage gate driving units, where n is an integer greater than 1. FIG. 10 shows the (m+1)th stage gate driving unit Sm+1, (m+2)th stage gate driving unit Sm+2, and the (m+n)th stage gate driving unit Sm+n.

The third gate driving subcircuit 13 includes p stage gate driving units, where p is an integer greater than 1. FIG. 10 shows the (m+n+1)th gate driving unit Sm+n+1, (m+n+p−1)th gate driving unit Sm+n+p−1, and (m+n+p)th gate driving unit Sm+n+p.

In FIG. 10, the gate driving signal output terminal of S1 is labeled as GO1, connected to the first row gate line (not shown in FIG. 10) in DA. The gate driving signal output terminal of S2 is labeled as GO2, connected to the second row gate line (not shown in FIG. 10) in DA1. The gate driving signal output terminal of Sm is labeled as GOm, connected to the mth row gate line in DA1. The mth row gate line in DA1 is also the last row gate line in the second display area, and the mth row gate line is not shown in FIG. 10.

In FIG. 10, the gate driving signal output terminal of Sm+1 is labeled as GOm+1, connected to the first row gate line (not shown in FIG. 10) in DA2. The gate driving signal output terminal of Sm+2 is labeled as GOm+2, connected to the second row gate line (not shown in FIG. 10) in DA2. The gate driving signal output terminal of Sm+n is labeled as GOm+n, connected to the nth row gate line in DA2. The nth row gate line in DA2 is also the last row gate line in DA2, and the nth row gate line is not shown in FIG. 10.

In FIG. 10, the gate driving signal output terminal of Sm+n+1 is labeled as GOm+n+1, connected to the first row gate line (not shown in FIG. 10) in DA3. The gate driving signal output terminal of Sm+n+p−1 is labeled as GOm+n+p−1, connected to the (p−1)th row gate line (not shown in FIG. 10) in DA3. The gate driving signal output terminal of Sm+n+p is labeled as GOm+n+p, connected to the pth row gate line in DA3. The pth row gate line in DA3 is also the last row gate line in DA3, and the pth row gate line is not shown in FIG. 10.

In one embodiment, the gate driving circuit further includes a control circuit 10, configured to control the type of the input signal input to Sm+1 to be the same as the type of the input signal input to Sm and control the type of the input signal input to Sm+n to be the same as the type of the input signal input to Sm+n+1 when the foldable display panel is in the full screen display state.

In FIG. 10, the label FL1 is a first folding line between DA1 and DA2, and the label FL2 is a second folding line between DA2 and DA3.

In one embodiment, as shown in FIG. 10, GOm is connected to the input terminal of Sm−1. The gate driving signal output terminal in the next stage gate driving unit in the first gate driving subcircuit 11 is connected to the input terminal of the adjacent previous stage gate driving unit in the first gate driving subcircuit 11. GOm+1 is connected to the input terminal of Sm+2. The gate driving signal output terminal in the previous stage gate driving unit in the second gate driving subcircuit 12 is connected to the input terminal of the adjacent next stage gate driving unit in the second gate driving subcircuit 12. GOm+n+2 is connected to the input terminal of Sm+n+1. The gate driving signal output terminal in the next stage gate driving unit in the third gate driving subcircuit is connected to the input terminal of the adjacent previous stage gate driving unit in the third gate driving subcircuit.

The control circuit includes a signal supply circuit 50 and a scan direction control circuit 51.

When the foldable display panel is in the full-screen display state, the scan direction control circuit is configured to control the backward scan performed on each gate driving unit in the first gate driving subcircuit 11, the forward scan performed on each gate driving unit in the second gate driving subcircuit 12, and the backward scan performed on each gate driving unit in the third gate driving subcircuit 13.

When the foldable display panel is in the full-screen display state, the signal supply circuit is configured to provide the input signal to the last stage gate driving unit in the first gate driving subcircuit 11, the input signal to the first stage of the gate driving unit in the second gate driving subcircuit (i.e., Sm+1), and the start signal to the last stage gate driving unit in the third gate driving subcircuit 13 (i.e., Sm+n+1).

The input signals input to Sm and Sm+1 are both square wave signals having no step, so that the difference between the gate driving signals output from Sm and Sm+1 can be reduced, thereby reducing the screen splitting phenomenon at FL1.

The start signal input to Sm+n+p may also be a square wave signal having no step, such that the input signal input to the last stage gate driving unit (i.e., Sm+n) of the second gate driving subcircuit 12 and the first stage gate driving unit of the third gate driving sub circuit 13 (i.e., Sm+n+1) are both square wave signals having a step, thereby reducing the difference between the gate driving signals output by Sm+n and Sm+n+1 and reducing the screen splitting phenomenon at FL2.

In one embodiment, the number of stages of the gate driving units in the second gate driving subcircuit 12 may be equal to the number of stages of the gate driving units in the third gate driving subcircuit 13, that is, n is equal to p, to ensure that the output delays of the upper and lower row gate driving units at the second folding line FL2 are the same. As such, the display difference does not occur at the boundary between the first display area and the second display area, and the screen splitting phenomenon is improved.

In one embodiment, the control circuit may include a signal supply circuit and a scan direction control circuit.

When the foldable display panel is in the full-screen display state, the scan direction control circuit is configured to control the forward scan performed on each gate driving unit in the first gate driving subcircuit, the backward scan performed on each gate driving unit in the second gate driving subcircuit, and the forward scan performed on each gate driving unit in the third gate driving subcircuit;

When the foldable display panel is in the full-screen display state, the signal supply circuit is configured to provide the start signal to the first stage gate driving unit in the first gate driving subcircuit, the input signal to the last stage of the gate driving unit in the second gate driving subcircuit, and the input signal to the first stage gate driving unit in the third gate driving subcircuit.

In one embodiment, the start signal input to the first stage gate driving unit of the first gate driving subcircuit, the input signal input to the last stage gate driving unit of the second gate driving subcircuit, and the input signal input to the first stage gate driving unit of the third gate driving subcircuit may all be square wave signals having no step to reduce the difference of the gate driving signals output from the last stage gate driving unit of the second gate driving subcircuit and the first stage gate driving unit of the third gate driving subcircuit, and improve the screen splitting phenomenon at the second folding line. The input signal input to the last stage gate driving unit of the first gate driving subcircuit, and the input signal input to the first stage gate driving unit in the second gate driving subcircuit may be square wave signals having a step to reduce the difference of the gate driving signals output from the last stage gate driving unit of the first gate driving sub circuit and the first stage gate driving unit of the second gate driving subcircuit, and improve the screen splitting phenomenon at the first folding line.

In one embodiment, the number of stages of the gate driving unit in the second gate driving subcircuit is equal to the number of stages of the gate driving unit in the first gate driving subcircuit to ensure the same output delays of the gate driving units at the upper and lower rows of the first folding line. As such, the display difference does not occur at the boundary between the first display area and the second display area, and the screen splitting phenomenon is improved.

In one embodiment, the control circuit may include a signal supply circuit and B−1 on-off control circuits.

The bth on-off control circuit is respectively connected to the gate driving signal output terminal of the last stage gate driving unit in the bth gate driving subcircuit and the input terminal of the first stage gate driving unit in the (b+1)th gate driving subcircuit. When the foldable display panel is in the full-screen display state, the bth on-off control circuit is configured to perform control to turn on the connection between the gate driving signal output terminal of the last stage gate driving unit in the bth gate driving subcircuit and the input terminal of the first stage gate driving unit in the (b+1)th gate driving subcircuit.

The signal supply circuit is configured to provide the first start signal to the first stage gate driving unit of the first gate driving subcircuit when the foldable display panel is in the full-screen display state.

In one embodiment, the first start signal may be a square wave signal having no step, the input signal input to the last stage gate driving unit in the bth gate driving subcircuit may be a square wave having a step, and the input signal input to the first stage gate driving unit in the (b+1)th gate driving subcircuit may also be a square wave signal having a step.

In one embodiment, the bth on-off control circuit is further configured to perform control to turn off the connection between the gate driving signal output terminal of the last stage gate driving unit in the bth gate driving subcircuit and the input terminal of the first stage gate driving unit in the (b+1)th gate driving sub-circuit when the foldable display panel is in the split screen display state.

The signal supply circuit is further configured to provide the start signal to the first stage gate driving unit of the first gate driving subcircuit when the foldable display panel is in the split screen display state and the first display area is in the displaying state.

The signal supply circuit is further configured to provide the start signal to the first stage gate driving unit of the (b+1)th gate driving subcircuit when the foldable display panel is in the split screen display state and the (b+1)th display area is in the displaying state.

Figure 11:
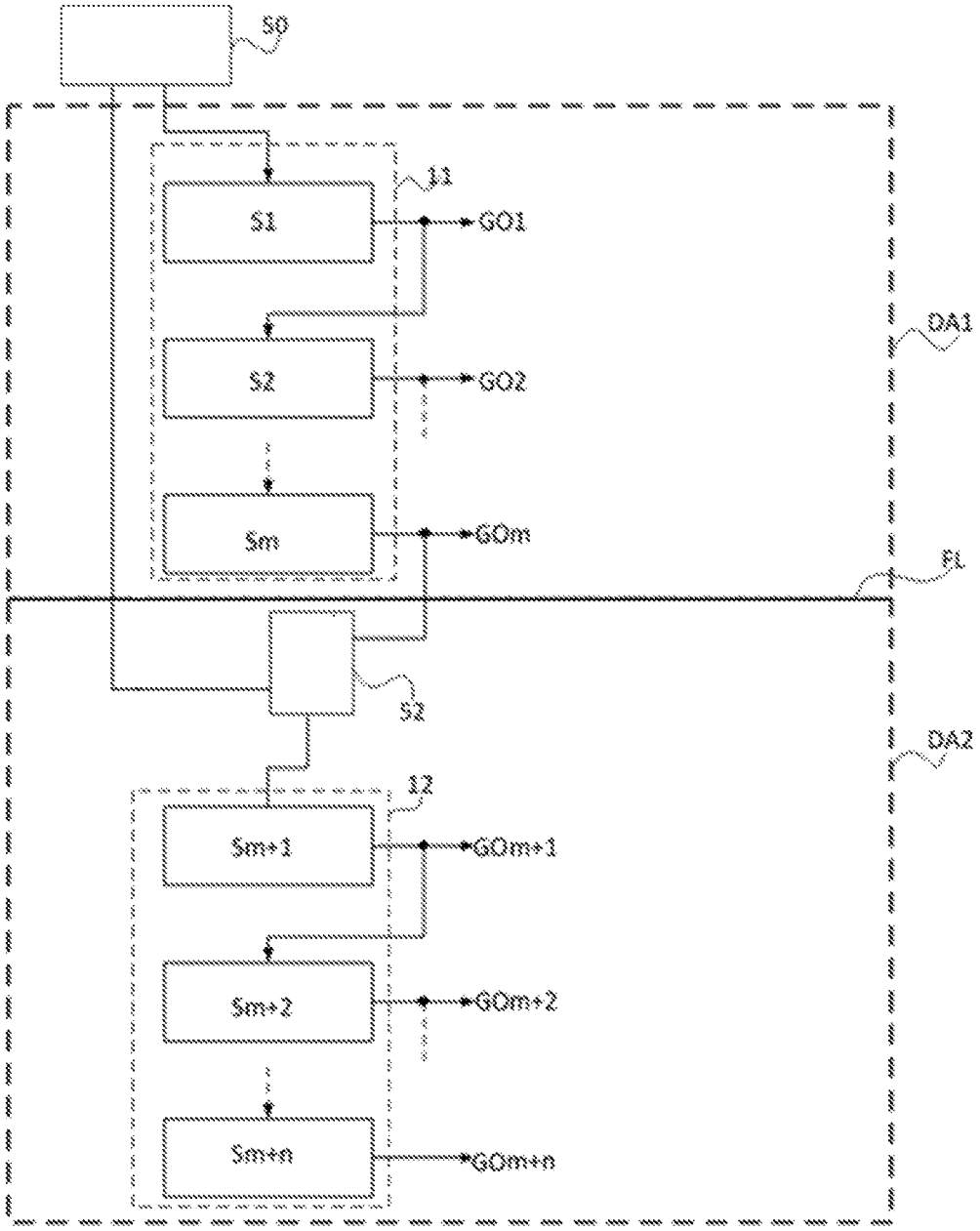
FIG. 11 is a schematic diagram of a gate driving circuit according to one embodiment of the present disclosure.

As shown in FIG. 11, in one embodiment, the control circuit includes a signal supply circuit 50 and an on-off control circuit 52.

The on-off control circuit 52 is respectively connected to the input terminals of Sm+1 and the output terminal GOm of the gate driving signal of Sm, and is configured to, when the foldable display panel is in the full screen display state, perform control to turn on the connection between the output terminals GOm of the gate driving signal of Sm and the input terminal of Sm+1. As such, the gate driving signal output by Sm is controlled to be used as the input signal of Sm+1, and the gate driving signal output by the last stage gate driving unit in the first display area DA1 is transmitted to the input terminal of the first stage gate driving unit in the second display area DA2. Therefore, the output step gradually changes and there is no obvious displaying difference.

The signal supply circuit 50 is configured to provide the first start signal to the first stage gate driving unit of the first gate driving sub circuit 11 when the foldable display panel is in the full-screen display state, thereby improving the screen splitting phenomenon.

The on-off control circuit 52 is further configured to perform control to turn off the connection between the gate driving signal output terminal of the Sm and the input terminal of Sm+1 when the foldable display panel is in the split screen display state.

The signal providing circuit 50 is further configured, when the foldable display panel is in the split screen display state and the first display area DA1 is in the displaying state, to provide the start signal to the first stage gate of the first gate driving subcircuit 11 to control the operation of the first gate driving subcircuit 1 and to drive each row of gate lines in the first display area DA1.

The on-off control circuit 52 is further configured to perform control to turn on the connection between the signal supply circuit 50 and the input terminal of Sm+1 when the foldable display panel is in the split screen display state and the second display area DA2 is in the displaying state.

The signal supply circuit 50 is further configured to: when the foldable display panel is in the split screen display state and the second display area DA2 is in the displaying state, provide a second start signal to the input terminal of the Sm+1 to control the operation of the second gate driving sub-circuit 12 and to drive the each row of the gate lines in the second display area DA2.

In one embodiment, as shown in FIG. 11, the first start signal may be a square wave signal having no step, and the input signal input to Sm may be a square wave signal having a step, and the input signal input to Sm+1 may be also a square wave signal having a step.

In one embodiment, the bth on-off control circuit may include the (2b−1)th control transistor and the 2bth control transistor.

The signal supply circuit includes the (2b−1)th control signal terminal and the 2bth control signal terminal.

The control terminal of the (2b−1)th control transistor is connected to the (2b−1)th control signal terminal of the signal supply circuit. The first terminal of the (2b−1)th control transistor is connected to the start signal output terminal of the signal supply circuit. The second terminal of the (2b−1)th control transistor is connected to the input terminal of the first stage gate driving unit in the (b+1)th gate driving subcircuit.

The control terminal of the 2bth control transistor is connected to the 2bth the control signal terminal of the signal supply circuit. The first terminal of the 2bth control transistor is connected to the gate driving signal output terminal of the last stage gate driving unit in the bth gate driving subcircuit. The second terminal of the 2bth control transistor is connected to the input terminal of the first stage gate driving unit in the (b+1)th gate driving subcircuit.

The signal supply circuit is further configured to: when the foldable display panel is in the split screen display state and the (b+1)th display area is in the displaying state, provide the (2b−1)th control signal through the (2b−1)th control signal terminal, and the 2bth control signal through the 2b control signal terminal, and the start signal through the start signal output terminal.

In one embodiment, when the foldable display panel is in the full-screen display state, the (2b−1)th control transistor is turned off under the control of the (2b−1)th control signal and the 2bth control transistor is turned on under the control of the 2bth control signal to control the connection between a gate driving signal output terminal of the last stage gate driving unit in the bth gate driving subcircuit and the input terminal of the first stage gate driving unit in the (b+1)th gate driving subcircuit. The gate driving signal output by the last stage gate driving unit in the bth gate driving subcircuit is transmitted to the input terminal of the first stage gate driving unit in the (b+1)th gate driving subcircuit. Therefore, the output step gradually changes and there is no obvious displaying difference.

In addition, when the foldable display panel is in the split screen display state and the (b+1)th display area is in the displaying state, the 2b control transistor is turned off under the control of the 2bth control signal and the (2b−1)th control transistor is turned on under the control of the (2b−1)th control signal to control the connection between the start signal output terminal of the signal supply circuit and the input terminal of the first stage gate driving unit in the (b+1)th gate driving subcircuit. The signal supply circuit provides the start signal to the input terminal of the first stage gate driving unit in the (b+1)th gate driving subcircuit.

Figure 12:
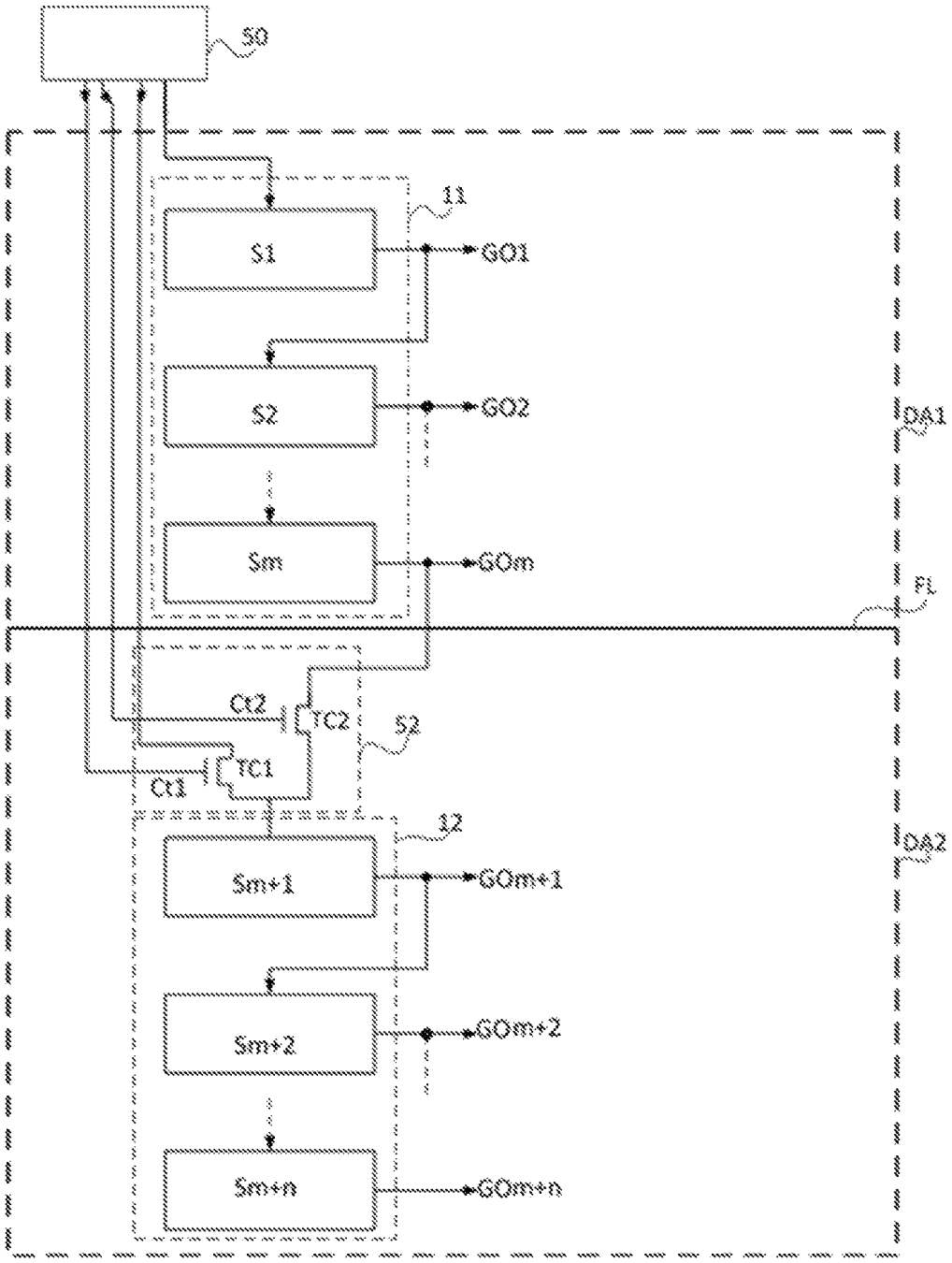
FIG. 12 is a schematic diagram of a gate driving circuit according to one embodiment of the present disclosure.

In one embodiment, as shown in FIG. 12, the on-off control circuit 52 may include a first control transistor TC1 and a second control transistor TC2.

The gate of the second control transistor TC2 is connected to the second control signal terminal Ct2. The drain of the second control transistor TC2 is connected to the gate driving signal output terminal of Sm. The source of the second control transistor TC2 is connected to the input terminal of Sm+1.

The gate of the first control transistor TC1 is connected to the first control signal terminal Ct1. The drain of the first control transistor TC1 is connected to the start signal output terminal of the signal supply circuit 50. The source of the first control transistor TC1 is connected to the input terminal of Sm+1.

In one embodiment, Ct1 and Ct2 signals may be provided by the signal supply circuit 50.

In FIG. 12, both TC1 and TC2 are N-type TFTs, but are not limited thereto.

In one embodiment, as shown in FIG. 12, two TFTs are provided between the first display area DA1 and the second display area DA2 to control the transmission of the GOA scan signal. When the full screen is displayed, TC2 is turned on, TC1 is turned off, and the GOA scan signal is transmitted through TC2 to the second display area DA2.

When only the first display area DA1 is in the displaying state, TC2 is turned off, TC is turned on, and the signal supply circuit 50 provides the second display area reset signal to the input terminal of Sm+1, such that the potential of the gate driving signal outputted by the second gate driving subcircuit 12 is an invalid voltage and the gate driving signal controls the pixel circuit in the corresponding second display area DA2 to be inactive. The signal supply circuit 50 provides an input signal to S1 to make the first gate driving subcircuit 11 perform a normal scan.

When only the second display area DA2 is in the displaying state, the signal supply circuit 50 provides the first display area reset signal to the input terminal of S1, such that the potential of the gate driving signal output by the first gate driving subcircuit 11 is an invalid voltage and the gate driving signal controls the pixel circuit in the corresponding first display area DA1 to be inactive. TC1 is turned on, TC2 is turned off, and the signal supply circuit 50 provides an input signal to Sm+1 to make the second gate driving subcircuit 12 perform a normal scan.

In one embodiment, when the foldable display panel includes a first display area, a second display area, and a third display area that are disposed in order from top to bottom, the control circuit may include a signal supply circuit, a first on-off control circuit, and a second on-off control circuit.

The first on-off control circuit is configured to, when the foldable display panel is in the full-screen display state, control the gate driving signal output terminal of the last stage gate driving unit in the first gate driving subcircuit to connect to the input terminal of the first stage gate driving unit in the second gate driving subcircuit to control the gate driving signal output by the last stage gate driving unit in the first gate driving subcircuit to be an input signal of the first stage gate driving unit in the second gate driving subcircuit. The gate driving signal output by the last stage gate driving unit in the first display area is transmitted to the input terminal of the first gate driving unit in the second display area. Therefore, the output step changes gradually, there is no obvious displaying difference, and the screen splitting phenomenon is improved.

The second on-off control circuit is configured to, when the foldable display panel is in the full-screen display state, control the gate driving signal output terminal of the last stage gate driving unit in the second gate driving subcircuit to connect to the input terminal of the first stage gate driving unit in the third gate driving subcircuit, to control the gate driving signal output by the last stage gate driving unit in the second gate driving subcircuit to be an input signal of the first stage gate driving unit in the third gate driving subcircuit. The gate driving signal output by the last stage gate driving unit in the second display area is transmitted to the input terminal of the first gate driving unit in the third display area. Therefore, the output step changes gradually, there is no obvious displaying difference, and the screen splitting phenomenon is improved.

The signal supply circuit is configured to provide a first start signal to the first stage gate driving unit of the first gate driving subcircuit when the foldable display panel is in the full-screen display state.

The first start signal may be a square wave signal having no step. The input signal input to the last stage gate driving unit in the first gate driving subcircuit may be a square wave signal having a step. The input signal input to the first stage gate driving unit in the second gate driving subcircuit may also be a square wave signal having a step. The input signal input to the last stage gate driving unit in the second gate driving subcircuit may also be a square wave signal having a step. The input signal input to the first stage gate driving unit in the third gate driving subcircuit may also be a square wave signal having a step.

In one embodiment, the first on-off control circuit is further configured to perform control to turn off the connection between the gate driving signal output terminal of the last stage gate driving unit in the first gate driving subcircuit and the input terminal of the first stage gate driving unit in the second gate driving subcircuit when the foldable display panel is in the split-screen display state.

The second on-off control circuit is further configured to perform control to turn off the connection between the gate driving signal output terminal of the last stage gate driving unit in the second gate driving subcircuit and the input terminal of the first stage gate driving unit in the third gate driving subcircuit when the foldable display panel is in the split screen display state.

The signal providing circuit is configured to, when the foldable display panel is in a split screen display state and the first display area is in the displaying state, provide a first start signal to the first stage gate driving unit in the first gate driving subcircuit to control the operation of the first gate driving subcircuit and drive each row of gate lines in the first display area.

The first on-off control circuit is further configured to, when the foldable display panel is in a split screen display state and the second display area is in the displaying state, perform control to turn on the connection between the signal supply circuit and the input terminal of the first stage gate driving unit in the second gate driving subcircuit.

The signal providing circuit is further configured to: when the foldable display panel is in the split screen display state and the second display area is in the displaying state, provide a second start signal to the first stage gate driving unit in the second gate driving subcircuit to control the operation of the second gate driving subcircuit and drive each row of gate lines in the second display area.

The second on-off control circuit is further configured to, when the foldable display panel is in the split screen display state and the third display area is in the displaying state, perform control to turn on the connection between the signal supply circuit and the input terminal of the first stage gate driving unit in the third gate driving subcircuit.

The signal supply circuit is further configured to: when the foldable display panel is in the split screen display state and the third display area is in the displaying state, provide a third start signal to the first stage gate driving unit in the third gate driving subcircuit to control the operation of the third gate driving subcircuit and drive each row of gate lines in the third display area.

Figure 13:
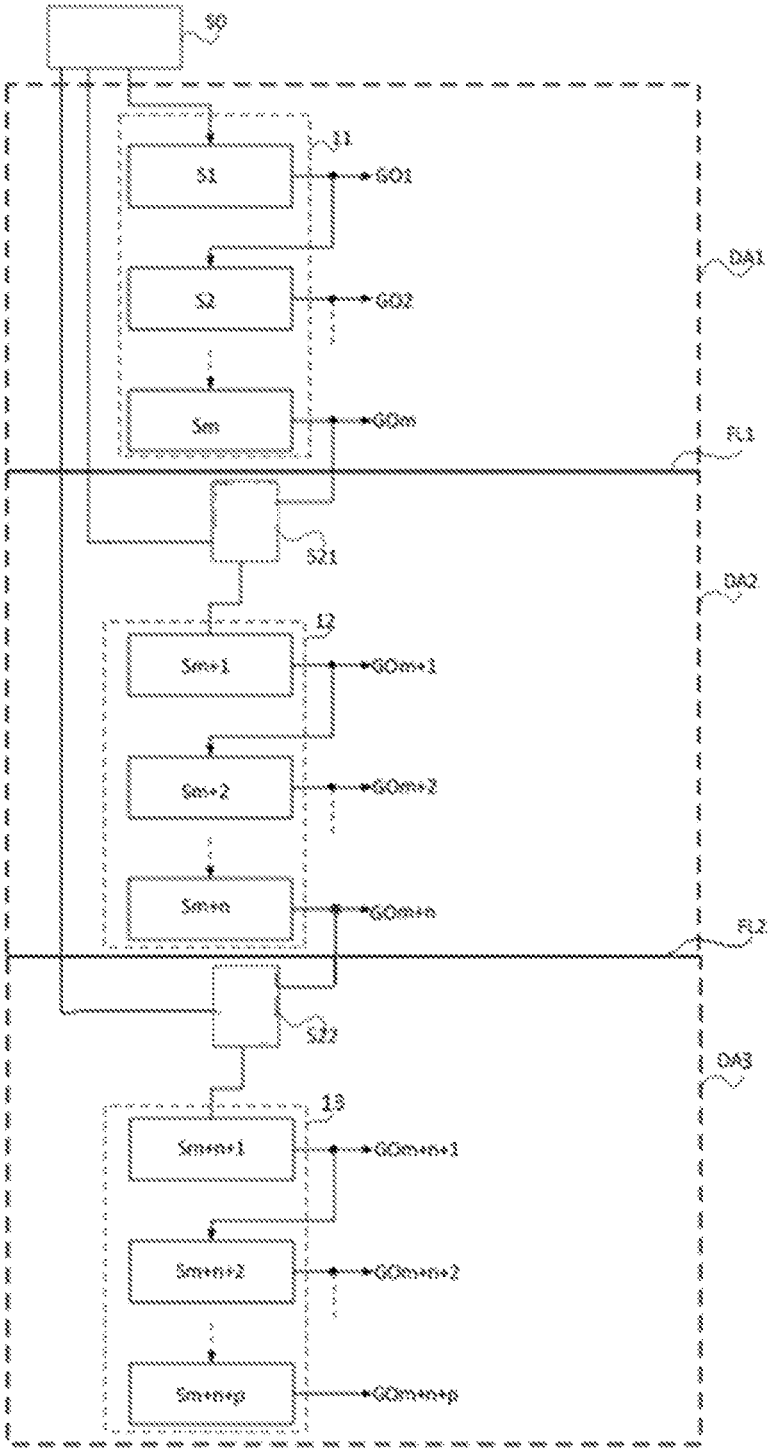
FIG. 13 is a schematic diagram of a gate driving circuit according to one embodiment of the present disclosure.

As shown in FIG. 13, in one embodiment, the control circuit includes a signal supply circuit 50, a first on-off control circuit 521 and a second on-off control circuit 522.

The first on-off control circuit 521 is respectively connected to the input terminal of Sm+1 and the gate driving signal output terminal GOm, and is configured to, when the foldable display panel is in the full screen display state, perform control to turn on the connection between the gate driving signal output terminal GOm and the input terminal of Sm+1 to control the gate driving signal output by Sm to be the input signal of Sm+1. The gate driving signal output by the last stage gate driving unit in the first display area DA1 is transmitted to the input terminal of the first gate driving unit in the second display area DA2. Therefore, the output step changes gradually and there is no obvious displaying difference.

The second on-off control circuit 521 is respectively connected to the input terminal of Sm+n+1 and the gate driving signal output terminal GOm+n, and is configured to, when the foldable display panel is in the full screen display state, perform control to turn on the connection between the gate driving signal output terminal GOm+n and the input terminal of Sm+n+1 to control the gate driving signal output by Sm+n to be the input signal of Sm+n+1. The gate driving signal output by the last stage gate driving unit in the second display area DA2 is transmitted to the input terminal of the first gate driving unit in the third display area DA3. Therefore, the output step changes gradually and there is no obvious displaying difference.

The signal supply circuit 50 is configured to provide a first start signal to the first stage gate driving unit of the first gate driving subcircuit 11 when the foldable display panel is in the full-screen display state;

The first on-off control circuit 521 is further configured to perform control to turn off the connection between the gate driving signal output terminal of Sm and the input terminal of the Sm+1 when the foldable display panel is in the split screen display state. The second on-off control circuit 522 is further configured to perform control to turn off the connection between the gate driving signal output terminal of Sm+n and the input terminal of Sm+n+1 when the foldable display panel is in the split screen display state.

The signal providing circuit 50 is further configured, when the foldable display panel is in the split screen display state and the first display area DA1 is in the displaying state, to provide the start signal to the first stage gate of the first gate driving subcircuit 11 to control the operation of the first gate driving subcircuit 11 and to drive each row of gate lines in the first display area DA1.

The on-off control circuit 521 is further configured to perform control to turn on the connection between the signal supply circuit 50 and the input terminal of Sm+1 when the foldable display panel is in the split screen display state and the second display area DA2 is in the displaying state.

The signal supply circuit 50 is further configured to: when the foldable display panel is in the split screen display state and the second display area DA2 is in the displaying state, provide a second start signal to the input terminal of the Sm+1 to control the operation of the second gate driving subcircuit 12 and drive each row of the gate lines in the second display area DA2.

The on-off control circuit 521 is further configured to perform control to turn on the connection between the signal supply circuit 50 and the input terminal of Sm+n+1 when the foldable display panel is in the split screen display state and the third display area DA3 is in the displaying state.

The signal supply circuit 50 is further configured to: when the foldable display panel is in the split screen display state and the third display area DA3 is in the displaying state, provide a third start signal to the input terminal of the Sm+n+1 to control the operation of the third gate driving subcircuit 13 and drive each row of the gate lines in the third display area DA3.

In one embodiment, as shown in FIG. 13, the first start signal may be a square wave signal having no step. The input signals input to Sm and Sm+1 may be square waves having a step. The input signals input to Sm+n and Sm+n+1 may also be square wave signals having a step.

Another embodiment of the present disclosure provides a gate driving method used for driving the gate driving circuit described above. The gate driving method includes:

When the foldable display panel is in a full screen display state, controlling the type of the input signal input to the last stage gate driving unit in the bth gate driving subcircuit to be the same as the type of the input signal input to the first stage gate driving unit in the (b+1)th gate driving subcircuit, b is a positive integer less than B, and B is an integer greater than 1.

In one embodiment, the gate driving circuit employs a control circuit. When the foldable display panel is in the full screen display state, the control circuit controls the type of input signal in the last stage gate driving unit of the bth gate driving subcircuit to be the same as the type of input signal in the first stage gate driving unit of the (b+1)th gate driving subcircuit. Thus, the difference of input signals is reduced between the last stage gate driving unit of the bth gate driving subcircuit and the first stage gate driving unit of the (b+1)th gate driving subcircuit, and the display difference is reduced at the boundaries between the bth display area and the (b+1)th display area, thereby improving the screen splitting phenomenon.

Another embodiment of the present disclosure provides a foldable display panel including the gate driving circuit described above.

Another embodiment of the present disclosure provides a display apparatus including the foldable display panel described above.

The display apparatus may be any product or component having a display function, such as a mobile phone, a tablet computer, a television, a display, a notebook computer, a digital photo frame, a navigator, and the like.

The above is a preferred embodiment of the present disclosure, and it should be noted that those skilled in the art can also make several improvements and modification without departing from the principles of the present disclosure. It should be considered as the scope of protection of the present disclosure.

What is claimed is:

1. A gate driving circuit applied to a foldable display panel comprising B display areas arranged in order, comprising:

B gate driving subcircuits, each of the gate driving subcircuits corresponding to one of the display areas and each of the gate driving subcircuits comprising a plurality of stage gate driving units; and a control circuit;

wherein the control circuit is configured to, in a full screen display state of the foldable display panel, control a type of an input signal in a last stage gate driving unit of a bth gate driving subcircuit to be the same as a type of an input signal in a first stage gate driving unit of a (b+1)th gate driving subcircuit, where B is an integer greater than 1 and b is a positive integer less than B;

the control circuit comprises a signal supply circuit and B−1 control gate driving units;

the signal supply circuit is configured to, in the full screen display state of the foldable display panel, provide a start signal to a first stage gate driving unit in a first gate driving subcircuit and start signals to the B−1 control gate driving units respectively; and a bth control gate driving unit is connected to a first stage gate driving unit of the (b+1)th gate driving subcircuit, and is configured to generate an input signal to the first stage gate driving unit of the (b+1)th gate driving subcircuit based on the start signal;

the bth control gate driving, unit has a same structure as one of the gate driving units in the gate driving subcircuits, and the bth control gate driving unit is a dummy gate driving unit that does not drive a gate line.

2. The gate driving circuit according to claim 1, wherein a gate line connected to the last stage gate driving unit of the bth gate driving subcircuit is adjacent to a gate line connected to the first stage gate driving unit in the (b+1)th gate driving subcircuit.

3. The gate driving circuit according to claim 1, wherein the input signal to the first stage gate driving unit of the (b+1)th gate driving subcircuit is a square wave signal having a step.

4. The gate driving circuit according to claim 1, wherein the type of the input signal in the last stage gate driving unit of the bth gate driving subcircuit is a square wave signal having a step or a square wave signal having no step.

5. The gate driving circuit according to claim 1, wherein each of the gate driving subcircuits comprises a same number of stage gate driving units.

6. A gate driving method for driving the gate driving circuit according to claim 1, comprising:

controlling the type of the input signal input to the last stage gate driving unit in the bth gate driving subcircuit to be the same as the type of the input signal input to the first stage gate driving unit in the (b+1)th gate driving subcircuit when the foldable display panel is in a full screen display state.

7. A foldable display panel comprising the gate driving circuit according to claim 1.

8. A display apparatus comprising the foldable display panel according to claim 7.

9. A gate driving circuit applied to a foldable display panel comprising B display areas arranged in order, comprising:

B gate driving subcircuits, each of the gate driving subcircuits corresponding to one of the display areas and each of the gate driving subcircuits comprising a plurality of stage gate driving units; and a control circuit;

wherein the control circuit is configured to, in a full screen display state of the foldable display panel, control a type of an input signal in a last stage gate driving unit of a bth gate driving subcircuit to be the same as a type of an input signal in a first stage gate driving unit of a (b+1)th gate driving subcircuit, where B is an integer greater than 1 and b is a positive integer less than B;

the control circuit comprises a scan direction control circuit, the scan direction control circuit is configured to control scan directions of adjacent gate driving subcircuits to be opposite;

the control circuit further comprises a signal supply circuit;

the scan direction control circuit is configured to, in the full screen display state of the foldable display panel, control a first direction scan performed on the gate driving units in a (2a−1)th gate driving subcircuit, a second direction scan performed on the gate driving units in a 2ath gate driving subcircuit, and a first direction scan performed on the gate driving units in a (2a+1)th gate driving subcircuit, where 2a+1 is less than or equal to B and a is a positive integer; and the signal supply circuit is configured to, in the full screen display state of the foldable display panel, provide start signals to the first stage gate driving unit in the (2a−1)th gate driving subcircuit, the last stage of the gate driving unit in the 2ath gate driving subcircuit, and the first stage gate driving unit in the (2a+1)th gate driving subcircuit, respectively; or provide the start signals to the last stage gate driving unit in the (2a−1)th gate driving subcircuit, the first stage of the gate driving unit in the 2ath gate driving subcircuit, and the last stage gate driving unit in the (2a+1)th gate driving subcircuit, respectively.

10. The gate driving circuit according to claim 9, wherein:

the first direction scan is a forward scan, and the second direction scan is a backward scan; and the signal supply circuit is configured to, in the full screen display state of the foldable display panel, provide the start signals to the first stage gate driving unit in the (2a−1)th gate driving subcircuit, the last stage of the gate driving unit in the 2ath gate driving subcircuit, and the first stage gate driving unit in the (2a+1)th gate driving subcircuit, respectively.

11. The gate driving circuit according to claim 10, wherein the number of stages of the gate driving units in the (2a−1)th gate driving subcircuit is equal to the number of stages of the gate driving units in the 2ath gate driving subcircuit.

12. The gate driving circuit according to claim 9, wherein:

the first direction scan is a backward scan, and the second direction scan is a forward scan; and the signal supply circuit is configured to, in the full screen display state of the foldable display, provide start signals to the last stage gate driving unit in the (2a−1)th gate driving subcircuit, the first stage of the gate driving unit in the 2ath gate driving subcircuit, and the last stage gate driving unit in the (2a+1)th gate driving subcircuit, respectively.

13. The gate driving circuit according to claim 12, wherein the number of stages of the gate driving units in the 2ath gate driving subcircuit is equal to the number of stages of the gate driving units in the (2a+1)th gate driving sub-circuit.

14. A gate driving circuit applied to a foldable display panel comprising B display areas arranged in order, comprising:

B gate driving subcircuits, each of the gate driving subcircuits corresponding to one of the display areas and each of the gate driving subcircuits comprising a plurality of stage gate driving units; and a control circuit;

wherein the control circuit is configured to, in a full screen display state of the foldable display panel, control a type of an input signal in a last stage gate driving unit of a bth gate driving subcircuit to be the same as a type of an input signal in a first stage gate driving unit of a (b+1)th gate driving subcircuit, where B is an integer greater than 1 and b is a positive integer less than B;

the control circuit comprises a signal supply circuit and B−1 on-off control circuits;

a bth on-off control circuit is respectively connected to a gate driving signal output terminal of the last stage gate driving unit in the bth gate driving subcircuit and an input terminal of the first stage gate driving unit in the (b+1)th gate driving subcircuit;

the bth on-off control circuit is configured to, when the foldable display panel is in the full-screen display state, perform control to turn on a connection between the gate driving signal output terminal of the last stage gate driving unit in the bth gate driving subcircuit and the input terminal of the first stage gate driving unit in the (b+1)th gate driving subcircuit; and the signal supply circuit is configured to, when the foldable display panel is in the full-screen display state, provide a first start signal to the first stage gate driving unit of the first gate driving subcircuit.

15. The gate driving circuit according to claim 14, wherein:

the bth on-off control circuit is further configured to, when the foldable display panel is in a split screen display state, perform control to turn off the connection between the gate driving signal output terminal of the last stage gate driving unit in the bth gate driving subcircuit and the input terminal of the first stage gate driving unit in the (b+1)th gate driving sub-circuit.

16. The gate driving circuit according to claim 15, wherein the signal supply circuit is further configured to, when the foldable display panel is in the split screen display state and a first display area is in a displaying state, provide the start signal to the first stage gate driving unit of the first gate driving subcircuit.

17. The gate driving circuit according to claim 15, wherein the signal supply circuit is further configured to, when the foldable display panel is in the split screen display state and a (b+1)th display area is in the displaying state, provide the start signal to the first stage gate driving unit of the (b+1)th gate driving subcircuit.

18. The gate driving circuit according to claim 14, wherein:

the bth on-off control circuit comprises a (2b−1)th control transistor and a 2bth control transistor, and the signal supply circuit comprises a (2b−1)th control signal terminal and a 2bth control signal terminal;

a control terminal of the (2b−1)th control transistor is connected to the (2b−1)th control signal terminal of the signal supply circuit, a first terminal of the (2b−1)th control transistor is connected to a start signal output terminal of the signal supply circuit, and a second terminal of the (2b−1)th control transistor is connected to the input terminal of the first stage gate driving unit in the (b+1)th gate driving subcircuit;

a control terminal of the 2bth control transistor is connected to the 2bth control signal terminal of the signal supply circuit, a first terminal of the 2bth control transistor is connected to the gate driving signal output terminal of the last stage gate driving unit in the bth gate driving subcircuit, and a second terminal of the 2bth control transistor is connected to the input terminal of the first stage gate driving unit in the (b+1)th gate driving subcircuit; and the signal supply circuit is further configured to: when the foldable display panel is in the split screen display state and the (b+1)th display area is in the displaying state, provide a (2b−1)th control signal through the (2b−1)th control signal terminal, a 2bth control signal through the 2b control signal terminal, and provide the start signal through the start signal output terminal.

* * * * *